US008091483B1

(12) United States Patent
Sumner

(10) Patent No.: US 8,091,483 B1
(45) Date of Patent: Jan. 10, 2012

(54) AMUSEMENT PARK RIDE WITH UNDERWATER-CONTROLLED BOATS

(75) Inventor: Mark W. Sumner, Saugus, CA (US)

(73) Assignee: Disney Enterprises, Inc., Burbank, CA (US)

( * ) Notice: Subject to any disclaimer, the term of this patent is extended or adjusted under 35 U.S.C. 154(b) by 0 days.

(21) Appl. No.: 13/076,845

(22) Filed: Mar. 31, 2011

(51) Int. Cl.
*A63G 1/00* (2006.01)

(52) U.S. Cl. ..... 104/73; 104/72; 104/59; 472/60

(58) Field of Classification Search ..... 104/23, 104/23.1, 23.2, 73, 72, 70, 59, 139, 154, 104/161, 60, 243; 472/117, 129, 135, 128, 472/127, 134
See application file for complete search history.

(56) References Cited

U.S. PATENT DOCUMENTS

| | | | | | |
|---|---|---|---|---|---|
| 1,563,855 | A * | 12/1925 | Held | 280/18 |
| 3,003,430 | A * | 10/1961 | Hamel | 104/72 |
| 3,113,528 | A * | 12/1963 | Morgan et al. | 104/73 |
| 3,404,635 | A * | 10/1968 | Bacon et al. | 104/70 |
| 4,149,469 | A * | 4/1979 | Bigler | 104/73 |
| 4,337,704 | A * | 7/1982 | Becker et al. | 104/70 |
| 4,392,434 | A * | 7/1983 | Durwald et al. | 104/70 |
| 5,295,442 | A * | 3/1994 | Carpenter | 105/176 |
| 5,473,990 | A * | 12/1995 | Anderson et al. | 104/85 |
| 5,613,443 | A * | 3/1997 | Ariga et al. | 104/70 |
| 5,732,635 | A * | 3/1998 | McKoy | 104/73 |
| 5,775,226 | A * | 7/1998 | Futami et al. | 104/71 |
| 5,860,364 | A * | 1/1999 | McKoy | 104/59 |
| 6,170,403 | B1 * | 1/2001 | Behringer | 104/59 |
| 6,237,499 | B1 * | 5/2001 | McKoy | 104/59 |
| 6,354,223 | B2 * | 3/2002 | McKoy | 104/72 |
| 6,354,448 | B1 * | 3/2002 | Ramne | 213/75 TC |
| 6,533,670 | B1 * | 3/2003 | Drobnis | 472/60 |
| 6,580,541 | B1 * | 6/2003 | Yamashita et al. | 398/104 |
| 6,592,374 | B1 * | 7/2003 | Kim | 434/58 |
| 6,629,501 | B2 * | 10/2003 | McKoy | 104/72 |
| 6,860,209 | B2 * | 3/2005 | McKoy | 104/72 |
| 6,971,317 | B2 * | 12/2005 | McKoy | 104/72 |
| 7,437,998 | B2 * | 10/2008 | Burger et al. | 104/73 |
| 2006/0130698 | A1 * | 6/2006 | Burger et al. | 104/73 |
| 2006/0219124 | A1 * | 10/2006 | Jordan | 104/23.1 |
| 2007/0207869 | A1 * | 9/2007 | Hunter | 472/117 |

* cited by examiner

*Primary Examiner* — Joe Morano, IV
*Assistant Examiner* — Jason C Smith
(74) *Attorney, Agent, or Firm* — Marsh Fischmann & Breyfogle LLP; Kent A. Lembke

(57) ABSTRACT

A boat ride with precise speed and orientation control. The ride includes a track assembly positioned in a water basin and includes front and rear bogies engaging the track assembly. The boat ride includes a passenger boat and front and rear tethering assemblies coupling the front and rear bogies, respectively, to the boat. The ride includes a propulsion assembly positioned along the track assembly that is operable to independently propel, with linear motors, the front and rear bogies at the same or differing first and second velocities by applying a magnetic force to reaction plates on the bogies. The track assembly includes a joined section and a divided section, which includes a primary track on which the front bogie travels and a secondary track, spaced apart from the primary track, on which the rear bogie travels. The boat may be rotated to any orientation in the divided track section.

18 Claims, 16 Drawing Sheets

AMUSEMENT PARK RIDE WITH UNDERWATER-CONTROLLED BOATS

BACKGROUND

1. Field of the Description

The present invention relates, in general, to water or boat-based amusement park rides, and, more particularly, to boat ride systems that are configured to permit each boat to be selectively operated at variable speed. The ride systems may provide underwater control to manage or set boat-to-boat spacing and boat position along a ride's path (e.g., along a length of a waterway or channel) to enhance display of a synchronized show to the ride's passengers. The ride systems may also be adapted to allow selective control and changing of the orientation of the boat relative to the direction of travel such as to turn a boat such that it faces to the left or right (and move the boat sideways along the ride path) or even to cause the boat to face backwards (and move the boat backwards along the ride path).

2. Relevant Background

Amusement parks continue to be popular worldwide with hundreds of millions of people visiting the parks each year. Park operators often seek new designs for rides, and it is often desirable that each ride incorporates a slower portion or segment to their rides to allow them to provide a "show" in which animation, movies, three-dimensional (3D) effects and displays, audio, and other effects are presented as vehicles proceed through such show portions. The show portions of rides are often run or started upon sensing the presence of a vehicle and are typically designed to be most effective when the vehicle travels through the show portion at a particular speed (e.g., the exact position of the vehicle is known along the ride's path).

Boat or water rides with floating vehicles are popular with park visitors especially during hotter seasons, and boat rides typically are designed to simulate movement of a floating boat such as a drifting raft or motorized craft. A common boat ride may include boats that each have guide wheels provided on sides of the boat, e.g., out of sight below the level of the water, to contact sides of a water channel or trough. Additional, wheels may be provided on the bottoms of the boats to roll the boat on ramped bottom surfaces of the trough. Each boat is moved forward along the length of the trough by propelling a volume of water down the trough in the desired direction of travel. The trough may be sloped to provide a gravity flow of the water and/or pumps may be provided to move water in flat or less sloped portions of the trough.

Use of flowing water is a proven and simple type of propulsion, but a number of limitations with boat rides have limited creation of new designs and integration of complex, synchronized show elements within boat rides. First, the boats are typically limited in their travel such that they only face forward or randomly twirl around in some river raft rides. This characteristic of boat rides creates limitations on controlling passenger sight lines, which can make it difficult to effectively present show elements to the passengers in comparison to dry ride systems where a vehicle can be controlled to face in any direction along a track.

Second, the boats may each travel at differing speeds such as varying within the range of 2 to 4 feet per second. This wide variance in speed may be caused by the boats being loaded differently such as with differing numbers and sizes of passengers. The varying loads results in heavier boats traveling faster than the more lightly loaded boats as the water flow rate varies within a channel (e.g., is faster at particular depth that may not be reached (or to a lesser amount) by lighter boats).

This creates unequal spacing of the boats (e.g., varying boat-to-boat spacing) as the faster boats catch up with the slower boats or leave the slower boats far behind. In high capacity rides, boats are dispatched relatively close together, and the natural variation in boat speeds causes the boats to clump together or spread apart, both results typically being undesired by the ride operators. Testing has shown that equally loaded boats may experience speed variances of up to 3 percent while unequally loaded boats may experience speed variances of up to 9 percent. Boat rides with unpredictable and varying boat speeds (and, hence, unknown positions) has blocked such attractions from having timed or triggered individual show scenes.

Boat rides can be designed to account for varying speed, but these rides have limited appeal to many amusement park operators. For example, varying boat speeds may be accounted for by providing an elaborate, and complex method of sorting boats based on their loading (and, hence, expected travel speeds in the flowing water in the trough) upstream of a show scene portion of a ride. Positive methods for sorting boats are typically mechanical, but these mechanical sorting arrangements tend to undesirably interrupt the "free floating" feel and pace of the boat ride. In some boat rides, a moving cable is provided within the trough, and each boat is tethered to the cable so that it is propelled by being pulled along with the cable instead of by moving water. Such towing cable rides are useful in some applications, but these rides are generally limited to a single boat speed, to flat or non sloped configurations to avoid boat collisions, and to a forward-facing boat orientation a single passenger sight line).

Hence, there remains a need for improved boat rides for use in amusement parks. Preferably, a boat ride system could be provided that provides better control over the speed, position, and orientation of each boat along the ride's travel path so as to allow show scenes to be better synchronized to boat movements through the ride and to provide a new and different ride experience, for passengers compared to existing rides using flowing water to propel boats.

SUMMARY

The present description describes a boat ride system that addresses the above and other problems with prior boat ride designs. The boat ride system does not use water to propel boats but, instead, provides a completely new way to propel boats through water. To this end, the boat ride system includes a number of boats adapted with seating for one or more passengers. The ride system includes a water trough or basin and an underwater guideway assembly that is adapted, in one embodiment, to guide, for each boat, two bogies (e.g., wheeled, roller coaster-type bogies or the like) within or on a guide track. For each boat, one bogie (i.e., a "front bogie") is attached via a tether assembly to the hull or boat bottom near the front of the boat and a second bogie (i.e., a "rear bogie") is attached via a tether assembly to the hull or boat bottom near the rear of the boat.

To propel the boats, one or both of the bogies includes a reaction plate such as a metallic plate or permanent magnet, and the guide track is fitted with linear motors that may take the form of a continuous line of linear synchronous motors (LSMs) or linear induction motors (LIMs). The ride system may include a controller or control system and power supply to selectively power the linear motors, e.g., the control system may be adapted for propulsion, position sensing, communications, and control of the ride system including the linear motors and, if present, show elements synchronized to boat positions and/or orientations along the guide track. The reaction plates may take the form of permanent magnets when the linear motors are LSMs, and the reaction plates on the bogies interact with the linear motors to provide propulsion of the bogies along the guide track and to the boat, which is tethered via the tether assemblies to the bogies. In other words, magnetic forces are applied in or along the direction of travel ("DOT") by the linear motors or magnetic thrusters (e.g., LSMs, LIMs, or the like arranged in a continuous or substantially continuous manner along the guide track) to rolling bogies to propel a tethered/linked boat. Magnetic forces may also be applied opposite the DOT to resist further travel of a boat by reducing its momentum or to slowly or quickly stop a boat a particular location on the guide track (e.g., the loading/unloading platform of the ride system).

In some embodiments, each bogie used to propel a boat may be controlled independently. For example, each bogie may be on a separate track within the guide track (or track assembly) while other embodiments may use track switches on various points/locations on the guide track to split a single track into two tracks with the front bogie following one track and the rear bogie following the other. In this manner, a boat may have a forward orientation with the front bogie and rear bogie following a single path for a portion of the ride (or a length or portion of the guide track) and may have differing orientations in other portions of the ride, e.g., the front and rear bogies of a single boat may follow differing paths that cause the boat to rotate and move sideways or even backwards along the guide track (e.g., a longitudinal axis of the boat or hull may initially be parallel to the longitudinal axis of the guide track and then rotate to be transverse to the guide track axis or parallel but with the front end of the boat facing the opposite direction). The bogies may also be driven at differing speeds such as to rotate one end of the boat relative to the direction of travel.

The ride system allows the boats to each have independently selected and controlled speeds (e.g., 0 to 4 feet per second, 0 to 12 feet per second, or ranges with an even higher maximum or upper speed), to have variable speeds along the guide track, to be fully stopped and then restarted along the ride, and to have a boat-to-boat spacing that is managed by a ride control system. These ride characteristics provide a ride system that may include triggered and timed show scenes as well as the ability to orient the boats to provide the passengers with desired viewing angles and sight lines. The control system may operate the linear motors along the guide track to move boats along the ride path defined by the guide track with the boats facing forward, sideways (in either direction), or backwards (and all positions between as the boats may be rotated 360 degrees about an axis extending between the two hull attachment points for front and rear bogies). The boats may be moved through larger bodies of water rather than only through narrow channels in a seemingly unguided manner, and the ride system provides a potentially more energy efficient ride when compared with use of pumped water for boat propulsion as energy only needs to be provided to move boats, not to move both boats and a body or volume of water through a channel.

More particularly, a boat ride is provided with precise control over speed and orientation of floating passenger boats along the length of the ride's waterway or channel. The ride includes a channel or basin for containing a volume of liquid such as water. The boat ride also includes a track assembly positioned within the basin such as on a concrete, fiberglass, or metal floor. The boat ride includes front and rear bogies each with two or more rollers engaging the track assembly (such as side wheels rolling on horizontal surfaces of rails and centering/aligning wheels continuously or periodically rolling on vertical sidewalls of the rails to keep the bogies centered within a guide channel or a track or such as use of sliding elements for guidance as well as or in place of rolling elements). The boat ride further includes a passenger boat and front and rear tethering assemblies coupling the front and rear bogies, respectively, to front and rear portions of the passenger boat. Further, the ride includes a propulsion assembly positioned along a length of the track assembly. Significantly, the propulsion assembly is operable to independently propel the front and rear bogies to roll along the track assembly at the same or differing first and second velocities.

In some cases, the propulsion assembly includes a plurality of linear motors supported within the track assembly. The front and rear bogies may each include a reaction plate for magnetically interacting with the linear motors so that the motors can propel the front and rear bogies at first and second velocities along a travel path defined by the track assembly. The bogie (and boat) velocities may be controlled to be within a range such as 0 to 4 feet per second, and the velocities of the two bogies may differ such as by at least 10 percent or more (note, though, that to practice the ideas described herein there is no lower limit to the differential speeds, e.g., very large radius curves may be utilized with a boat moving sideways with very little differential speeds). In some cases, the linear motors comprise linear synchronous motors or linear induction motors (with the reaction plates/members being one or more permanent magnet or metal (e.g. aluminum) plate).

In the boat ride, the track assembly may include a joined section (or single track section or section in which two tracks are abutting/proximate) and a divided section. The divided section may include a primary track on which the front bogie travels and a secondary track, spaced apart a distance from the primary track, on which the rear bogie travels. During operation of the ride, the boat rotates to a sideways orientation in the divided section, with a longitudinal axis of the boat being transverse to a travel path defined by the track assembly. In some embodiments, the track assembly includes track switches, without moving parts, which function to direct the front bogie into the primary track from the joined section and direct the rear bogie into the secondary track from the joined section.

Also, during ride operation, the propulsion assembly is operated to rotate the boat in the divided section to orient the boat such that the boat travels backwards through the joined section. In some cases, the front tethering assembly includes a rigid link pivotally coupled at a first end to the front and at a second end to the front portion of the boat via a boat mounting element, and the boat mounting element may be pivotally coupled to a stop assembly configured to allow the boat mounting element to rotate through a stroke distance (e.g., 1 to 3 inches or more of play to minimize risks of binding as the boat moves through curved sections of the divided track segments).

DETAILED DESCRIPTION OF THE PREFERRED EMBODIMENTS

Briefly, embodiments of boat rides or ride systems described herein make use of linear motors with integrated position and communication capabilities to propel boats at known and, typically, variable speeds and with changes in the boat orientations (e.g., turning the boat sideways to view a set or show feature provided along the ride path).

For example, a relatively simple boat ride may be provided by a system with a single track that is attached to a waterway or trough floor. Two bogie assemblies (e.g., wheeled bogies) are provided for each boat, and the bogie assemblies are each fitted to and roll on the track. Flexible tethers or tether assemblies that pivot upon each end but include a rigid link separately connect one bogie to the front of a boat and one bogie to the rear of the boat. In some embodiments, one of the bogies has a reaction plate (such as a permanent magnet or a metal plate such as an aluminum plate or block) attached to it that is facing or proximate to (e.g., spaced apart a short distance such as less than about 3 inches or the like) a set of linear motors positioned within the track below the rails or portions of the track supporting the bogies. The linear motors are selectively operated to apply a magnetic-based thrust upon the reaction plate and the bogie on which it is mounted to move the bogie along the track, which causes the boat to be pulled or pushed via the tether assemblies through the waterway or trough (which is filled with a volume of water to cause the boat to float over the track or to provide vertical support of the boat).

Some embodiments of the ride systems will be configured, though, to provide enhanced abilities to orient boats in different positions, such as turning the front end to one side or even to face backwards (e.g., provide 360 degree rotation of the boat or some smaller amount in either direction). In one such embodiment, the track assembly or guide track includes a dual track arrangement with separate tracks for the front bogie and for the rear bogie to allow the bogies to be controlled and/or positioned independently. The two tracks may only be separated in areas of the ride where alternate boat orientations are desired, and, at other locations, the two tracks may be arranged parallel to each other or track switches may be used to convert back into a single track configuration (e.g., in regions where the boat is facing fully forward or fully backwards a single track may be utilized).

Figure 1:
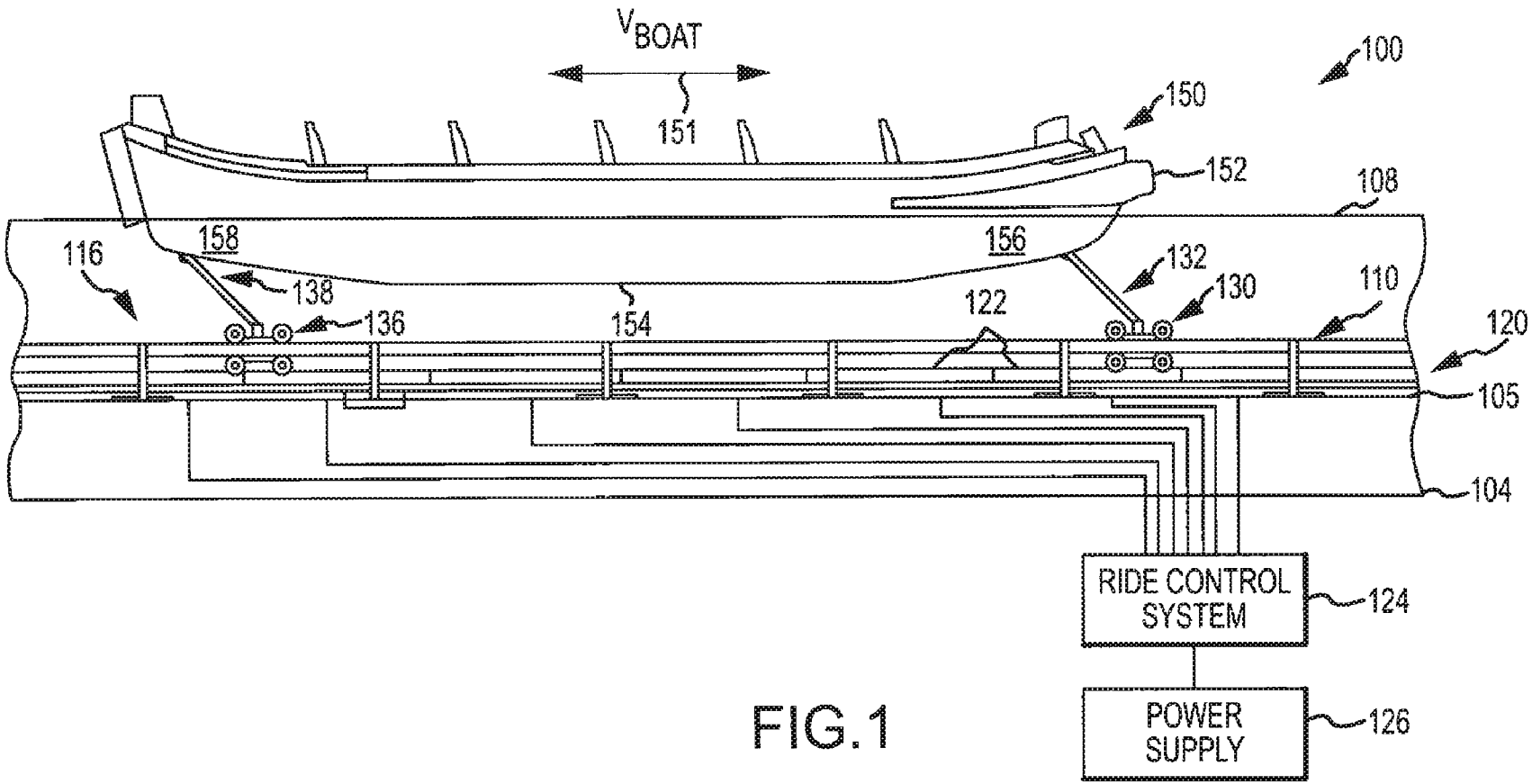
FIG. 1 is a simplified, partial side view of a boat ride or boat ride system illustrating use of linear motors to propel a boat in a waterway or trough filled with water.

FIG. 1 illustrates a portion of an embodiment of a boat ride or boat ride system 100. As shown, the ride system 100 includes a basin, pool, channel, or trough 104 that may be formed of concrete (or other material) walls and a floor/base configured to contain a large volume of a liquid 108 such as water (i.e., configured to define a waterway for a water ride). The ride system 100 further includes a guide track or track assembly 110 that is mounted on a bottom or lower surface 105 of the water channel 104.

Figure 2:
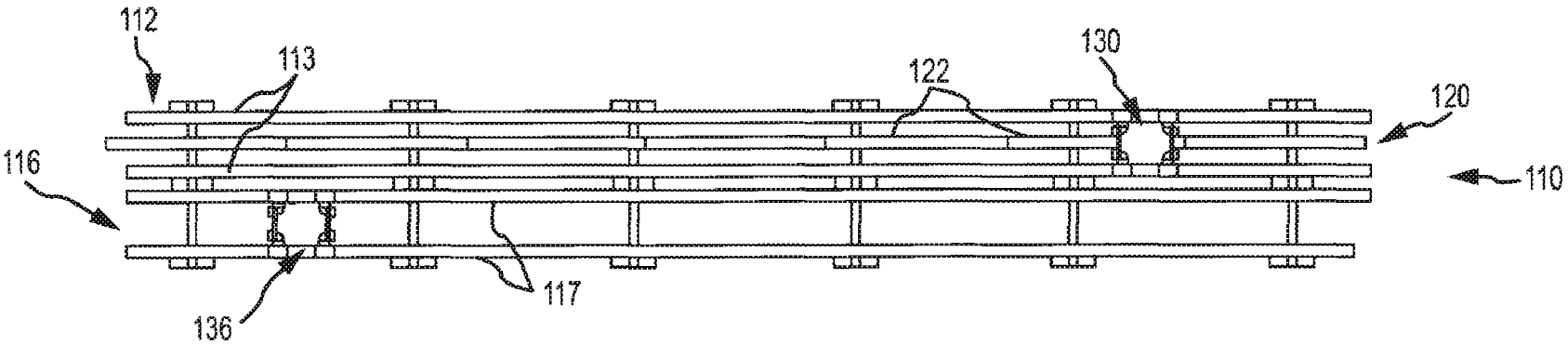
FIG. 2 illustrates a top view of the boat ride system of FIG. 1 with the boat removed to expose the guide track or track assembly.
Figure 3:
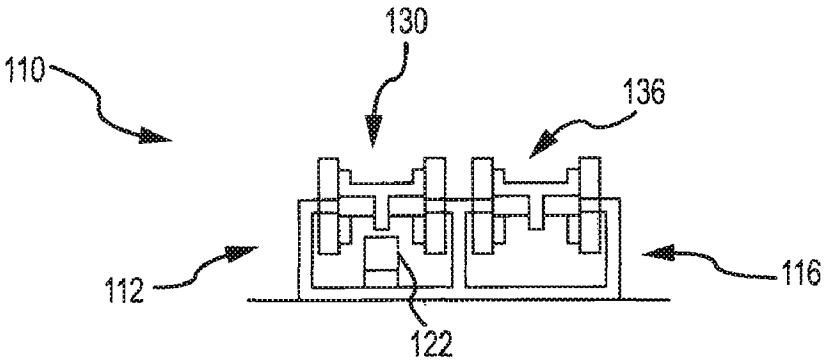
FIG. 3 is an end view of the track assembly of FIG. 2 showing positioning of the linear motors relative to bogie with a reaction plate.

With further reference to FIGS. 2 and 3, the track assembly 110 includes two side-by-side tracks that may be labeled a primary or front bogie track 112 and a secondary or rear bogie track 116. The tracks 112, 116 may take a conventional roller coaster-type guide track form for containing wheeled chassis or bogies used to convey vehicles in amusement park rides. The primary and secondary tracks 112, 116 include pairs of spaced apart rails 113, 117, respectively, for receiving and supporting a front bogie 130 and a rear bogie 136. The bogies 130, 136 include a chassis or body with wheels or rollers, and, during operating of the ride system 100, the bogies 130, 136 rollably engage (and may be retained upon) the rails 113, 117 and roll along the track assembly 110 in a guided manner to follow a ride path or proceed in a DOT defined by a longitudinal axes of the primary and secondary tracks 112, 116.

Significantly, the front and rear bogies 130, 136 are separately controlled or guided along two different paths by the use of the two tracks 112, 116. The primary and secondary tracks 112, 116 are shown in FIGS. 1-3 to be side-by-side in the same plane and abutting or proximate such that the ride path followed by both bogies 130, 132 is nearly identical. This may be useful in a straightaway or straight length of ride system 100 in which orientation of a towed or pushed boat is fully forward facing or fully rearward facing (i.e., forward or backward orientation of a boat). However, the separate tracks 112, 116 provide separate control and positioning of the bogies 130, 136 such that the tracks 112, 116 may later become spaced apart to allow a towed or pushed boat to be reoriented. This may involve the rear bogie 136 being positioned side-by-side with the front bogie 130 as the two bogies 130, 136 travel along a DOT of the ride system 100 so as to cause a boat to face sideways (in either direction) or some position in between. For the side-by-side track configuration, the boats may only be rotated in one direction and rotated back only in the opposite direction. The single track with track switched configuration may be used to allow rotation in either direction. Also, with the side-by-side track configuration, the boat may not achieve a full 180-degree rotation for true backward motion (or do a full 360-degree rotation). In prior configurations, a single tow cable had been utilized such that only one travel path and one speed could be provided in a cable-based boat ride.

The boat ride system 100 further includes a passenger boat 150 with a hull 152, and it is shown to be able to travel 151 in either direction at a particular rate or velocity, $V_{Boat}$. In some water rides 100, this may be a range from 0 to 4 feet per second, with 2 to 4 feet per second being common values for the boat velocity, $V_{Boat}$. The hull 152 has a bottom or lower surface 154 with a front 156 and a rear 158. The front 156 of the boat hull 152 is connected to the front bogie 130 with a first tether assembly 132, and the rear 158 of the boat hull 152 is connected to the rear bogie 136 with a second tether assembly 138.

The tether assemblies 132, 138 may include flexible members such as cables or chains and/or may include rigid link such as metal rods, bars, or the like, but, in many assemblies 132, 138, the connection at the hull 152 and at the bogie 130, 136 is at least pivotal (such as with a ball joint at the bogie chassis and a pivotal joint at the hull 152) to provide some amount of lateral movement and/or longitudinal movement along the DOT, as well as the ability for pitch motions and vertical heave motions, which may be useful to enhance the free-floating sensation and to account for tolerances in fabrication and relative positioning of the tracks 112, 116, as well as water surface variations such as waves. The pivotal connections are also useful (such as at the bogies 130, 136) so as to allow the boat 150 to be reoriented such as to be rotated to 0 to nearly 180 degrees (or a sideway or rotated orientation) and pulled along the waterway 104 sideways.

To provide propulsion of the boat 150 in straight sections of track assembly 110 as shown in FIGS. 1-3, the ride system 100 includes a propulsion assembly 120 that includes a plurality of linear motors 122. The linear motors 122 may be arranged in a continuous (or with some spacing as allowed by the type of motors and drive needs of the system 100) manner along the length of the track assembly 110. Specifically, as shown in FIGS. 2 and 3, the propulsion assembly 120 may include a number of linear motors 122 arranged end to end length-wise that are positioned and supported within the primary or front bogie track 112. The linear motors 122 are positioned to be spaced apart but proximate to the rails 113 such that the front bogie 130 rolls over the linear motors 122, and the front bogie includes one or more reaction plates (such as permanent magnets or metal plates (e.g., an aluminum plate or fin)).

The linear motors 122 create a magnetic field that is moved along the length of the track 110 to apply a repulsive or attractive force on the front bogie 130 (or its reaction plate). This causes the front bogie 130 to move 151 along the track assembly 110 at a rate, $V_{Boat}$, that can be carefully controlled and adjusted (on a bogie-by-bogie basis (in sections of the track assembly 110 with linear motors that drive the rear bogie 136) and vehicle-by-vehicle basis in a ride system 100). The linear motors 122 may include integral position communication and controls, and the propulsion assembly 120 is shown to include a ride control system 124 that selectively operates the linear motors 122 such as by providing power via power supply 126 to the motors 122 (e.g., to move the magnetic field down the length of each motor 122 at a particular rate).

The control system 124 may include one or more computer processors that run software (such as ride programs) or respond to offboard communications corresponding to a ride program to selectively move the boat 150 along the track assembly 110. The control system 124 may also be used to activate show elements/scenes and to position/orient the boat 150 to have a line of sight and travel rate, $V_{Boat}$, useful for better experiencing the show elements. As the front bogie 130 is caused by the linear motors 122 to move 151 in a DOT along the primary track 112, the boat 150 is towed along behind via the tether assembly 132 attached to the front 156 of the hull 152. The rear bogie 136, in this straight section of track 110, is pushed along by the rear 158 of the hull 152 via rigid tether assembly 136 so as to travel along the DOT defined by the secondary track 116 (and to maintain the rear 158 on this DOT, which substantially corresponds with the DOT of the primary track 112).

The control system 124 is configured for controlling a speed of vehicles or boats 150 of the ride system 100. For example, the control system 124 may utilize magnetic pacers or linear motors 122 to maintain the boat 150 at a velocity, $V_{Boat}$, that is within an acceptable speed or velocity range or band, e.g., at velocities in a relatively tight band about a design or goal velocity for a particular show effect. The linear motors 122 are controlled and powered to generate magnetic forces either opposite the DOT to decelerate the boat 150 or in the DOT to propel the front bogie 130 and towed boat 150. The linear motors 122 are mounted, in the illustrated embodiment, to the track 112 such that they are provided in a plane that is substantially parallel to a plane containing the reaction plate on the bogie 130 rolling on rails 113.

In general, each of the linear motors 122 is formed using an electromagnet or series of electromagnets that are selectively powered to develop the magnetic force that controls the speed of the boat 150 in the ride 100. The control features allow the forces to be rapidly changed from one direction to another (such as by switching polarity) to decelerate a boat or to accelerate a boat whereas mechanical devices such as tow cables are run in one direction. The control features also typically allow the linear motors 122 to only be operated when needed such as when a vehicle is adjacent one of the linear motors 122, and a speed determination indicates that the velocity, $V_{Boat}$, needs to be modified (e.g., a boat velocity is out of a design speed band or is greater or less than trigger values for operating the thrusters 122). In some embodiments, the amount of force is also variable such that a linear motor 122 can be used to apply a force of a magnitude that is selected based on the determined speed of the vehicle such as a greater force when the vehicle significantly differs from a velocity target or a lesser force when the vehicle only slightly differs from the desired velocity range. The reaction plates on the bogies 130, 136 may both vary significantly to practice the invention, and it is believed that those skilled in the art will readily understand how to implement these components of the invention.

In some cases, the linear motors are linear induction motors (LIMs) or linear synchronous motors (LSMs) because both of these magnetic thrusting technologies are well developed and understood and both are well-suited for providing the level of control over magnetic thrust forces applied to an amusement park ride vehicle as described herein. A linear motor such as an LIM or LSM is generally an electric motor with a linear or unrolled stator so that instead of producing a torque it produces a linear force along its length that is proportional to the current and the magnetic field. LIMs are thought of as high-acceleration motors and have an active three-phase winding on one side of the air gap and a passive conductor plate on the bogies 130, 136. LSMs are, in contrast, considered low-acceleration, high speed and power motors that have an active winding on one side of the air gap and an array of alternate-pole magnets (e.g., the reaction plate on the bogies 130, 136, which may be permanent magnets or energized magnets) on the other side of the air gap.

Embodiments of the propulsion assembly 120 may include components presently distributed or on the market. For example, the linear motors 122 may be LSMs such as LSMs available from companies such as MagneMotion, Inc. of Devens, Mass., USA (e.g., an LSM from the QuickStick™ line of LSMs or LSM systems). Similarly, the power and control components (such as position sensing devices) 126, 124 may be provided by companies in the magnetic drive industry such as MagneMotion, Inc., but, of course, these components would be configured to operate according to the control processes of the present invention and for use in the particular arrangements taught herein for adjusting speed of boats, such as boat 150, in boat or water rides 100. Some available LSM products provided in a package can be used as or as part of the linear motors of the invention and may include a stator package (e.g., about ½ meter or more in length) that includes the equipment necessary to generate a magnetic field and to measure the speed and position of a vehicle. These stator packages can be installed on or near a track in an end-to-end manner. In some cases, each stator package may be provided with an external power source connected via a serial communications line to an upstream and/or downstream position of the stator package. The linear motors 122 will be configured and designed for submerged service to allow their placement and continued use in a basin 104 filled with water or other liquid 108.

For example, a series of linear motors 122 (e.g., LSMs, LIMs, or the like) may be powered by a power supply 126 via a power cable attached to the motors 122, and the power may be provided in a controlled manner (e.g., timing of on/off based on determined velocities of adjacent vehicle, direction of magnetic field selected based on velocity, and, in some cases, amount of power controlled based on variance from a target or trigger velocity value). A communications line typically will also be provided to provide control signals from a controller 124 (e.g., a combination of software and hardware such as a CPU, memory, and the like) and to provide sensor signals from sensors (e.g., position sensors) provided in or near the linear motors 112 to the controller 124. The controller 124 may use the position signals to synchronize operation of the linear motor 122, and the controller 124 uses the position signals to determine the velocity, $V_{Boat}$, of the boat 150. This determined velocity is then compared to a target velocity and/or against minimum and maximum trigger values hounding this target velocity to determine whether a magnetic force should be applied to one or both of the bogies 130, 136 (i.e., whether the linear motor(s) 122 should be operated to adjust the boat velocity) and, if so, which direction and, in some cases, at which magnitude to apply the force (i.e., as a propulsion force or as a resistive or braking force).

Figure 4:
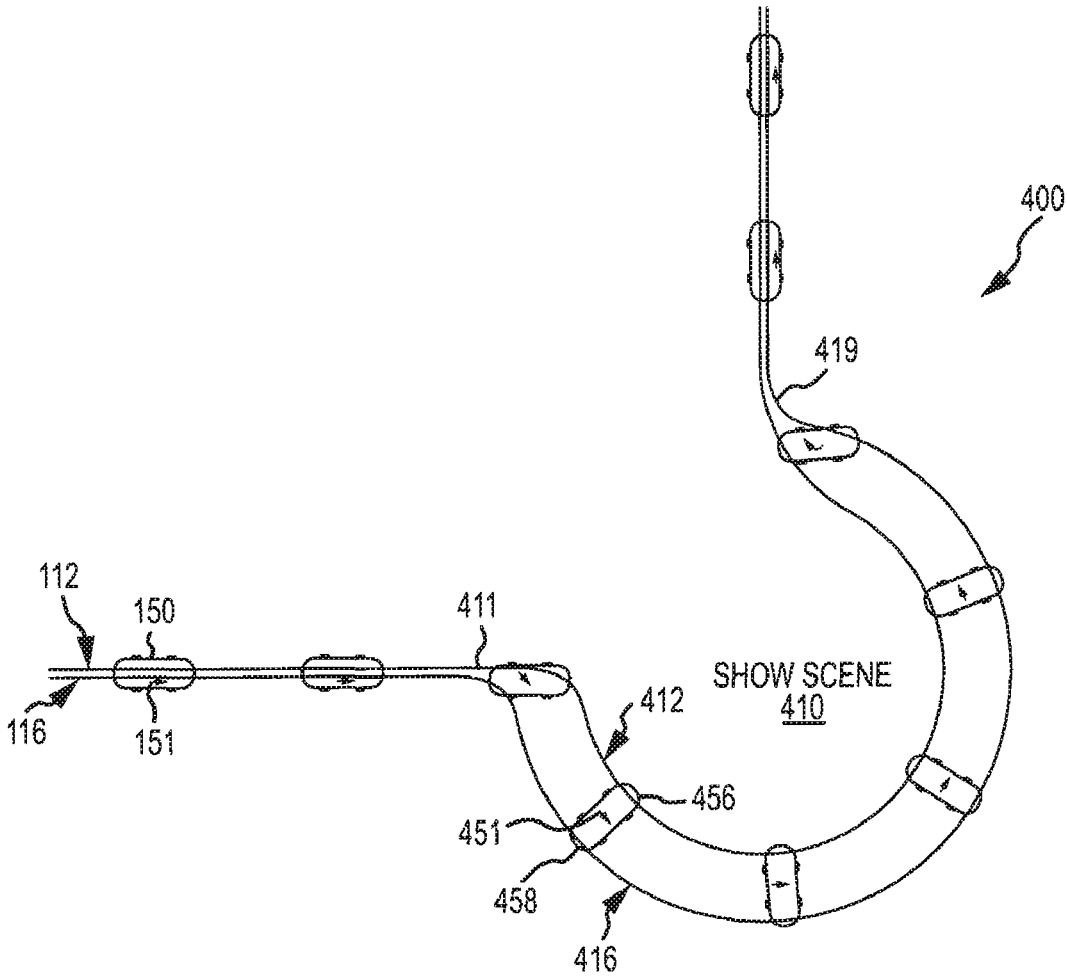
FIG. 4 is a schematic of a portion of boat ride with a show scene portion in which the two bogie tracks of the guide track are split or spaced apart and arranged so as to cause the boats to rotate to orient the front end of the boats toward a show scene and to cause the boats to move sideways along the ride path.

FIG. 4 illustrates another embodiment of a ride system 400 that utilizes components of the system 100 of FIG. 1, and these components have like reference numerals. For example, the ride system 400 is shown to include a straightaway or straight portion in which a boat 150 travels forward 151, and this portion may correspond with the ride system 100 shown in FIGS. 1-3. In this section, as discussed above, the boat 150 is caused to move 151 at a rate by operation of linear motors 122 provided in a continuous manner on the primary track 112. In other words, only one set of linear motors 122 is required to propel the boat 150 forward along the track assembly or in a DOT (e.g., a linear path) with the boat 150 oriented to face forward.

As mentioned above, the use of separate rails and tracks 112, 116 for guiding the front and rear bogies 130, 136 allows the ride system 400 to be configured so as to selectively change the orientation of the boats in the ride system 400. For example, a show scene 410 may be provided in the ride system 400, and it may be desirable to rotate each boat of the ride system 400 as the boats pass along (in a circular path as shown or other route) the show scene 410 at a known velocity (to synchronize operation of the show scene 410 with the known position of each boat or sets of boats). In prior boat rides, the sight line of passengers in a boat was nearly always fixed to be forward along the direction of travel, but ride system 400 allows boats to be rotated sideways (e.g., rotated from about 0 degrees to nearly 180 degrees in one direction and then rotated back the other direction to or toward the original orientation).

For example, the ride system 400 includes a track separation point 411 in the track assembly 110 following the straightaway. Separated portions 412, 416 of the primary and secondary tracks 112, 116 are shown to separate at point 411 and be spaced apart (some distance less than a maximum separation distance allowed by the mounting locations of the tethering assemblies 132, 138 and the lengths of the connecting links or tethers in such assemblies 132, 138) such as less than about the length of the boat hull 152 or distance between the connection points of the tether assemblies 132, 138 to the front and rear 156, 158 of the bottom 154 of the hull 152.

As shown in FIG. 4, the boat 450 has been rotated about 90 degrees such that its front end 456 faces or is proximate to the show scene 410 while its back end 458 faces or is distal to the show scene 410. After the separation point 411, the boat 450 is moved 451 sideways along the DOT defined by the segments 412, 416 of the primary and secondary tracks 112, 116. In this manner, the configuration of the primary and secondary tracks 112, 116 allows separate positioning and control over the front and rear bogies 130, 136 so as to orient the boat 450, e.g., toward a show scene 410 or otherwise to achieve a desired ride experience.

While not shown in FIG. 4, upstream or at separation point 411, the propulsion assembly of ride system 400 includes linear motors (similar to motors 122 of FIG. 1) in the secondary track segment 416 as well as in primary track segment 412. The rear bogie 136 may be configured similar to front bogie 130 so as to include one or more reaction plates to interact with or be influenced by magnetic forces of such linear motors. In this manner, the front and rear bogies 130, 136 can both be propelled in separate and spaced apart track segments 412, 416. The two sets of linear motors in the track segments 412, 416 may be operated similarly such that the front and rear bogies 130, 136 travel at the same or similar velocities, which may be useful to maintain a boat orientation, or they may be operated differently to cause one bogie and corresponding boat end 456, 458 to travel at a faster velocity.

In other words, the front and rear bogies 130, 136 are separately controlled to set their velocities, which may differ or be the same, to achieve a desired boat movement and orientation throughout the ride system 400. For example, near the separation point 411, it may be useful to have the rear end 458 moved faster to rotate the boat 450 to face toward the show scene (i.e., to have the rear 458 of the boat 450 catch up to the front 456 such they travel parallel to each other in segments 412, 416). Then, the rear bogie's speed may be set to match or be only somewhat greater than the front bogie's speed via control of the two sets of linear motors to cause sideways movement 451 of the boat 450 (e.g., the rear bogie may have to move somewhat faster to cover the longer outside track segment 458 to maintain the front 456 facing inward to show scene 410).

The ride system 400 also includes a union or joining point or location 419 in which the segments 412, 416 again come into proximity (as shown in FIGS. 1-3) to be side-by-side. Upstream of the point 419, the speed of the rear bogie 136 may be slowed relative to the speed of the front bogie 130 such that the boat 450 is rotated to a forward orientation, as shown in FIG. 4. If, instead, the rear bogie were sped up further the rear end 458 of the boat 450 would be placed in a forward part of the straight portion of the track downstream of union location 419 such that the boat 450 would travel backwards, which may be desirable in some applications or stretches of the track assembly of ride system 400.

By providing two separate tracks for the front and rear bogies (at least in a portion of the track) and separately propelling the bogies, the ride system 400 is operable to precisely control the speed of each boat and to also control their orientation relative to a DOT defined by the primary and secondary tracks. Further, the use of linear motors allows precise knowledge and control over the positions of each boat in the ride system 400.

FIGS. 1-4 are useful in explaining an embodiment of a ride system in which the bogies are always in separate tracks (i.e., a primary and a secondary track) even when the boat is oriented to be forward or backward. However, there may be applications where it is desirable to utilize a single track in segments or portions of the track assembly in which a boat is oriented to be facing fully forward or fully backward. Switches or similar devices may then be used to direct the front and rear bogies into front and rear bogie tracks in separated track segments (such as separation point 411 in FIG. 4). This track configuration allows the boat to be rotated in either direction up to 360 degrees and allows the boat to run when turned up to 180 degrees and to run backwards. At this point, it may be useful to more fully describe embodiments of various components that may be used in such a switch embodiment, and details of embodiments of bogies and tethering assemblies.

Figure 5:
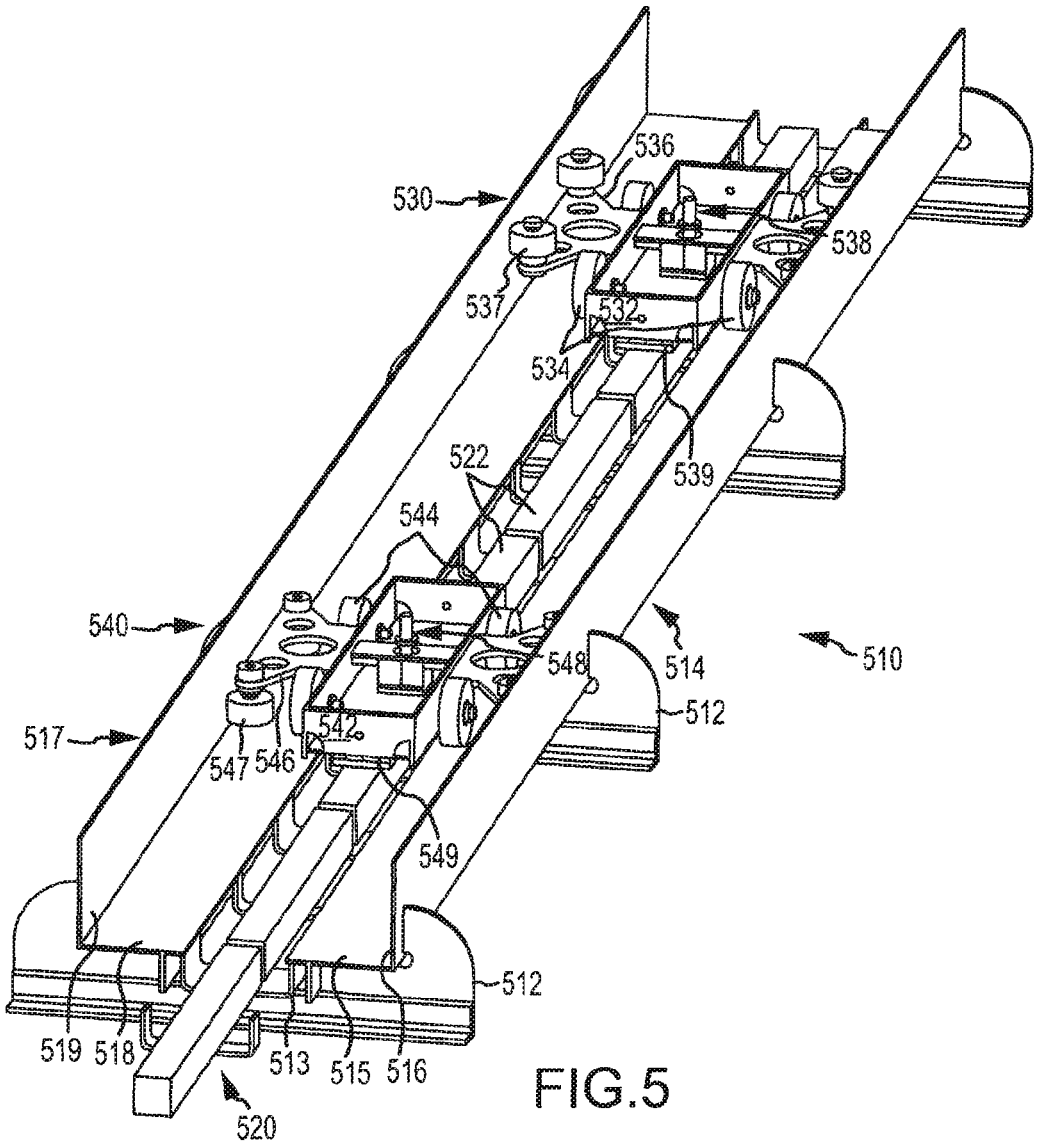
FIG. 5 illustrates a perspective top view of a segment of a track assembly such as may be used in the ride system of FIGS. 1-4, showing front and rear bogies with reaction plates for interacting with linear motors extending along the length of in track assembly.

FIG. 5 illustrates a segment of a track assembly 510 that may be used in a portion of a ride in which a boat is facing forward or backwards (e.g., the longitudinal axis of the boat hull is generally aligned to be parallel with the longitudinal axis of the track assembly 510 or a DOT). As shown, the track assembly 510 includes mounts or bases 512 that are used to affix the track assembly 510 to a floor or bottom of a water basin or trough (not shown).

The mounts/bases 512 provide vertical support for a right rail 514 and a left rail 517, which are each provided with first and second sidewalls 515, 516, 518, 519 (e.g., horizontal sidewalls or shelves and vertical sidewall that may be orthogonal to each other as shown and be open inward to receive a bogie). The rails 514, 517 extend the length of the segment 510 in a parallel manner to define a ride path (e.g., a path that may correspond to or be parallel to the longitudinal axes of rails 514, 517). Hangers 513 are provided that extend within the space between the spaced apart rails 514, 517, and this central, elongated space exposes a plurality of linear motors 522 of a propulsion assembly 520 that are supported upon the hangers 513. In this manner, the motors 522 have an upper surface that is exposed within the track assembler 510 between the two rails 514, 517.

A front bogie 530 and a rear bogie 540 are shown as they may be positioned when linked to a boat (not shown). Specifically, the front bogie 530 is shown to include a chassis or body 532 (e.g., a rectangular box or the like), and wheels 534 are pivotally attached to the chassis 532 to provide vertical support for the bogie 530 on horizontal walls 515, 518 of rails 514, 517. To center the bogie chassis 532 between the two vertical walls 516, 519 of rails 514, 517, the front bogie 530 includes arms 536 extending laterally outward from the chassis 532 upon which a number of rollers or wheels 537 are pivotally supported and roll upon the vertical sidewalls 516, 519 of rails 514, 517. The centering wheels 537 may also be used in switching operations, and the centering wheels 537 of the front bogie 539 may be positioned on an upper surface of the arms 536 (or opposite surface used to support the centering wheels 547 of the rear bogie). Use of the centering wheels 537 for switching is explained below.

The front bogie 530 further includes a reaction plate 539 (such as a permanent magnet or metal plate) on a lower surface such that the reaction plate 539 is proximate to but spaced apart a small distance from the upper surface of the linear motors 522 of propulsion assembly 520. During operation of a ride with track assembly 510, the front bogie 530 is caused to roll on wheels 534 rollably engaging sidewalls 515, 518 by magnetic forces applied to the reaction plate. The front bogie 530 further includes pivotal connector 538 on an upper surface of chassis 532, which facilitates coupling to an end of a first or front tethering assembly (not shown in FIG. 5) in a manner that allows the coupled end to pivot a limited amount in any direction. The connector 538 may include a ball joint or similar mechanism to provide such pivotal coupling to chassis 532.

Similarly, the rear (or second) bogie 540 includes a chassis 542 upon which a reaction plate 549 is mounted (on a lower surface) to interact with linear motors 522. The chassis 542 pivotally supports vertical support wheels 544 that roll upon horizontal sidewalls 516, 518 of rails 514, 517. Arms 546 extend laterally outward from both sides of chassis 542 to support centering wheels/rollers 547, which roll upon vertical sidewalls 516, 519 so as to align the chassis 542 between the rails 514, 517 and the reaction plate 549 over the upper surface of the linear motors 522. Operation of the linear motors 522, hence, is used during operation of a ride with assembly 510 to propel the rear bogie 540 along the track assembly 510 (e.g., along a path parallel to the longitudinal axes of the rails 514, 517). The centering wheels 547 are pivotally mounted on arms 546 on a lower surface of the arms 546 (or opposite to that of wheels 537 of front or first bogie 530) to facilitate switching operations or independently controlling the rear bogie relative to the front bogie 530 (e.g., directing the rear bogie 540 along a different path defined by a track assembly 510).

Figure 6:
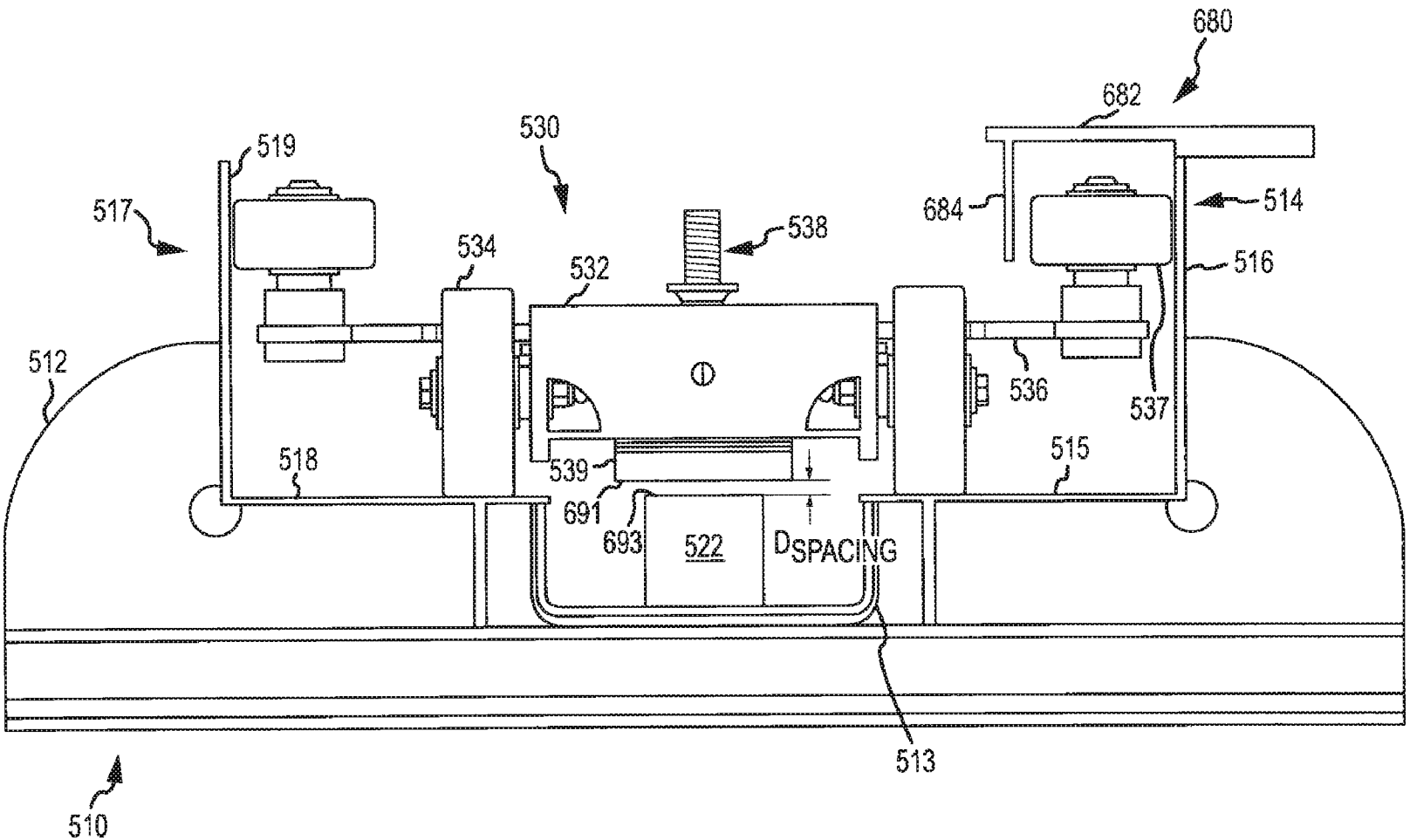
FIG. 6 is an end view of the track assembly of FIG. 5 illustrating the front bogie in more detail in a portion of the track assembly with a front bogie switching element used to direct the front bogie into a separate front track segment.

FIG. 6 illustrates an end view of the front bogie 532 providing further detail of its components. The front bogie 530 is shown to be supported vertically by wheels/rollers 534 pivotally supported (such as with axles) by the body/chassis 532 as they contact and roll upon sidewalls 515, 518. The aligning/centering wheels or rollers 537 act to center the chassis 532 over the gap between rails 514, 517 that contains the linear motors 522, which are supported on hangers (or channel supports) 513. As a result, the reaction plate 539 has an outer (lower) surface 691 proximate to and facing an upper surface 693 of the linear motors 522. The two surfaces 691, 693 interact magnetically to drive the bogie 530 along the rails 514, 517, but the surface 691, 693 do not contact and are spaced apart a distance, $d_{spacing}$ (such as up to 3 inches or more but often less than about 1 inch).

A track assembly may also be configured to split or branch into two tracks such as a front bogie or primary track and a rear bogie or secondary track. In such segments or sections of the track assembly, it is useful to separately direct or control the front and rear bogies to cause these bogies to travel into these two divided tracks. To this end, the aligning/centering wheels 537 are mounted on a first surface (upper surface in this example) of the arms 536 to face a first direction (upward with their rotation axis orthogonal to the DOT).

The track assembly then may include a front bogie switching assembly or mechanism 680 affixed to one of the sidewalls of the rails (here shown on the right side rail 514 but may be on the left side rail 517). As shown, the front bogie switching assembly 680 includes an extension element or plate 682 connected to the sidewall 516 and extending (inward) toward the opposite rail 517 above the centering wheel 537. The assembly 680 further includes a guide or directing sidewall or vane 684 extending downward from the cantilevered end of the extension element 682. This L-shaped assembly 680 defines a channel through which the wheel 637 is restricted to travel, and it can be used to cause the front bogie 530 to branch into a primary or first bogie rail on the right of the track assembly 510 shown in FIG. 5. If the assembly 680 is provided, instead, on the left rail 517, the front bogie 530 can be switched or directed to branch into a leftward leading primary track (e.g., to veer or turn to the left into a divided or separated track segment).

Figure 7:
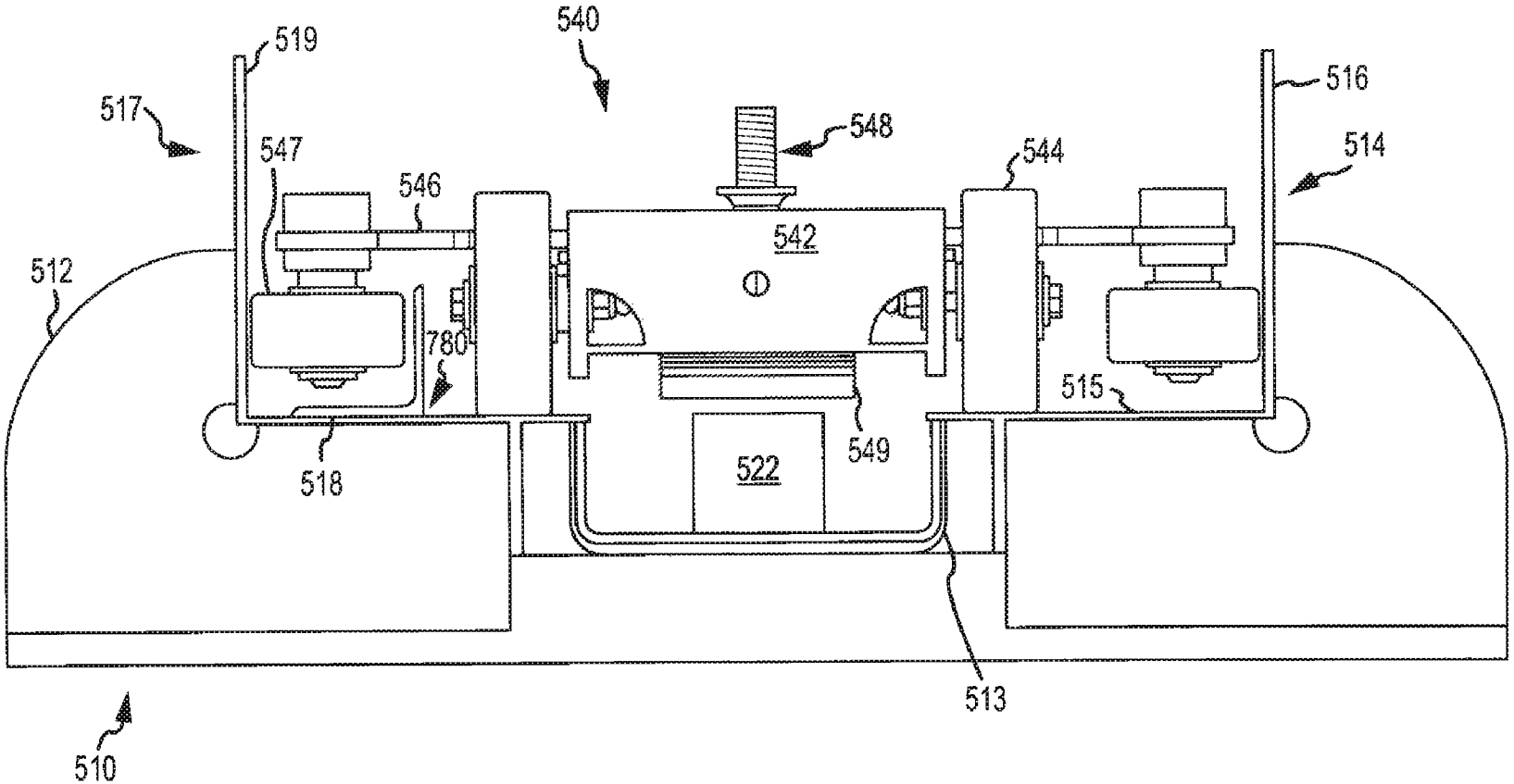
FIG. 7 is an end view of the track assembly of FIG. 5 illustrating the rear bogie in more detail in a portion of the track assembly with a rear bogie switching element used to direct the rear bogie into a separate rear track segment.

Similarly, FIG. 7 illustrates an end view of the rear bogie 540 shown in track assembly 510 in FIG. 5. As with the front bogie, the reaction plate 549 is spaced a small distance from a linear motor 522 used to propel the chassis 542 along the rails 514, 517 while the aligning/centering wheels or rollers 547 retain the chassis 542 centered over the gap between rails 514, 517 and the linear motor 522. The aligning/centering wheels 547 extend downward from a second surface (lower surface in this example) of the arms 546 to face a second direction (downward with their rotation axis orthogonal to the DOT and opposite the centering wheels of the front bogie 530).

The track assembly then may include a rear bogie switching assembly or mechanism 780 affixed to one or the sidewalls of the rails (here shown on the left side rail 517 but may be on the right side rail 514). As shown, the rear bogie switching assembly 780 takes the form of a length of angle iron or the like with a wall affixed to lateral sidewall 518 and a vertical wall extending upward from the sidewall 518 to define a channel through which the wheel 547 is restricted to travel. The rear bogie switching assembly 780 can be used to cause the rear bogie 540 to branch into a secondary or second bogie rail on the left of the track assembly 510 shown in FIG. 5. If the assembly 780 is provided, instead, on the right rail 514, the rear bogie 540 can be switched or directed to branch into a rightward leading secondary track (e.g., to veer or turn to the right into a divided or separated track segment).

Figure 8:
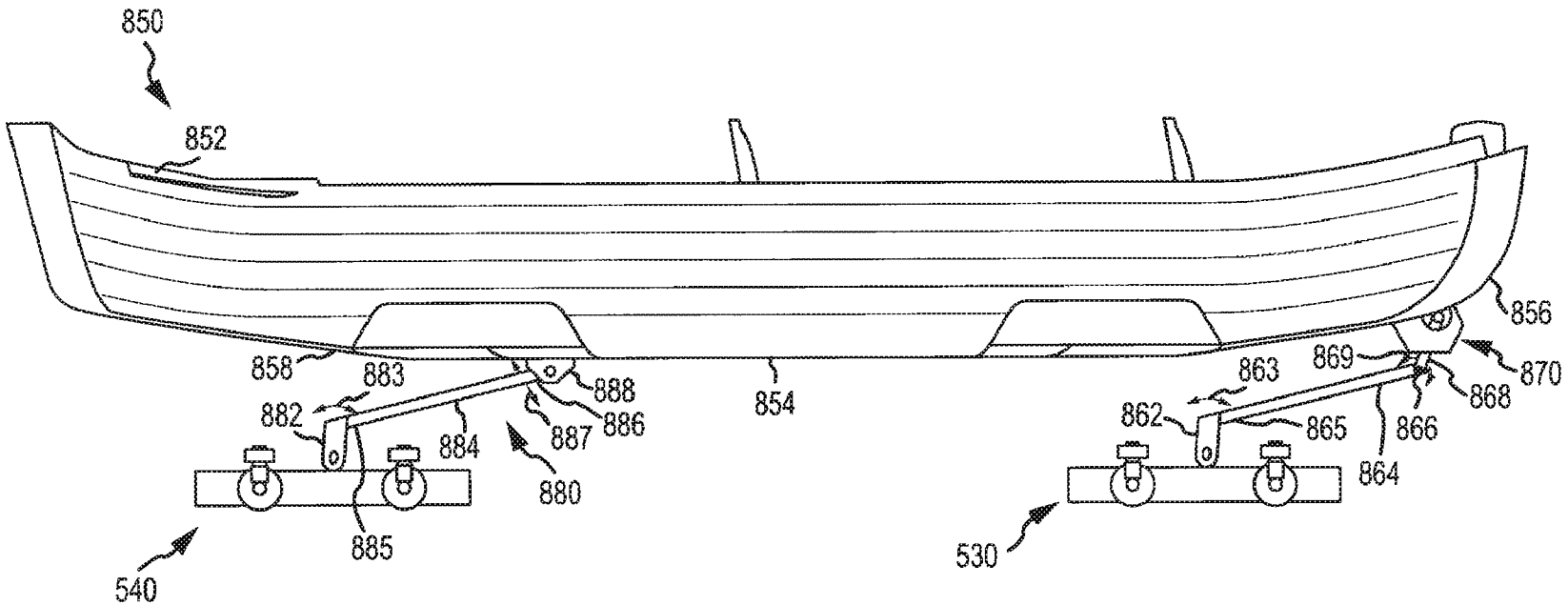
FIG. 8 is a side view of a boat that may be used in a ride system described herein and showing exemplary front and rear bogies coupled to the boat hull with front and rear tethering assemblies.

FIG. 8 illustrates a side view of a boat 850 that may be selectively propelled along a track assembly of the present invention. To this end, the boat 850, which is adapted for seating 2 to 4 or more passengers (not shown), includes an elongated hull 852 with a bottom or lower surface 854. The boat 850 is coupled to a front bogie 530 and a rear bogie 540, which may be configured as shown in FIGS. 5-7. The front bogie 530 is pivotally coupled to the front 856 of the boat bottom 854 while the rear bogie 540 is pivotally coupled to the rear 858 of the hull 852 on the bottom 854 such as at a spacing of 5 to 10 feet or more. The separation distance between the bogie connection points 856, 858 may vary to practice the invention and may vary to suit varying ranges of lengths of boat hulls 852 and desired track separations or ride dynamics in a water ride, as this separation distance can limit or set maximum separation between primary and secondary tracks. In contrast to the boat 150 of FIG. 1, the boat 850 is pushed along a track assembly when the bogies 530, 540 are propelled by a set of linear motors in the track assembly.

Figure 9:
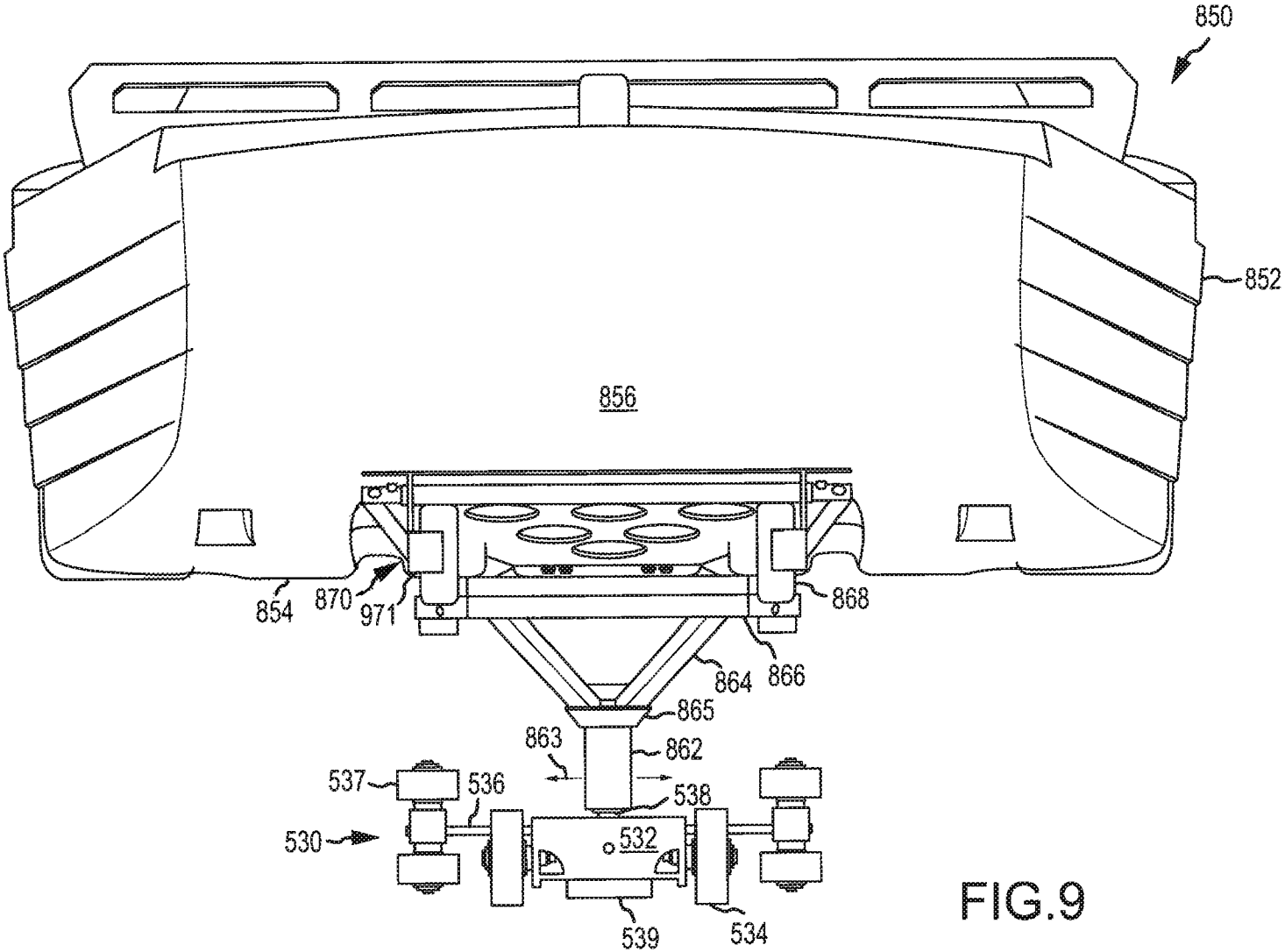
FIG. 9 is a front end view of the boat of FIG. 8 showing the front tethering assembly in more detail include hard stops controlling forward and rearward movement/pivoting of a rigid link.

To this end, the front bogie 530 is linked to the front 856 of the boat 850 via a first tethering assembly 860. The tethering assembly 860 and its connection to the front 856 of the hull 852 are shown in FIG. 9. Further, as shown in FIGS. 8 and 9, the tethering assembly 860 includes a bogie mounting element 862 (e.g., a length of a rigid member such as a section of a metal channel, a rod, or the like) that is attached to the pivotal coupling 538 on the upper surface of the chassis 532, which allows the mounting element 862 and tethering assembly 860 to pivot or move 863 at least side-to-side but more typically in any direction (such as through the use of a ball joint or the like).

The tethering assembly 860 also includes an elongated, rigid link 864 that is rigidly coupled at a first end 865 to the top of the bogie mounting element 862. The coupled two elements 862, 865 may pivot together as a unit as shown with arrow 863 in FIG. 8 about the connection to bogie 530 at element 538. The length of the link 864 may vary but typically will be between 2 to 6 feet. The link 864 extends up from the bogie 530 at an angle such as one in the range of 20 to 60 degrees, and the link 864 is rigidly attached at a second end 866 via a cross bar, in this example, to boat mounting element 868. The boat mounting element 868 may take the form of a cross arm/beam pivotally attached to a hard stop assembly 870 (which is rigidly attached to the front 856 of the boat bottom 854). The cross beam of element 868 can pivot about its axis and a pair of arms extend outward from the boat hull 852 to the cross bar/beam at the end 866 of the tether link 864.

The stop assembly 870 includes forward and rear hard stops 971 that are spaced apart a distance (such as 1 to 6 inches or more, with about 2 to 3 inches of stroke provided in one prototype) to defined an amount of forward/rearward or longitudinal travel along the DOT for the link 864 as shown with arrows 869 for arms of boat mounting element 868 and the coupled end 866 of link 864. This extra stroke provides an amount of play to account for lateral compliance between the bogies 530, 540 in split track segments (e.g., as the boat is being turned sideways or is traveling along a segment of split track in such a sideways orientation) to reduce risks of binding of the rolling bogies 530, 540. In contrast, the pivoting 863 of the link 864 provides a free-floating feel to the boat 850 while the boat 850 is actually accurately guided and restrained via the tethering assembly 860 to the bogie 830 that is guided along a primary track.

The rear bogie 540 is coupled to the rear 858 of the boat with rear tethering assembly 880. The rear tethering assembly 880 is configured similarly to the front tethering assembly 860, in this example. A bogie mounting element 882 is connected to the bogie chassis for pivoting 883, and the mounting element 882 is rigidly coupled with elongated link 884 at a first end 885 of the link 884, and the second end 886 is pivotally coupled (as shown with arrows 887) at a second end 886 to a hull mounting assembly 888. For example, a cross bar 886 may have its two ends pivotally supported by hull mounting assembly 888. In contrast to front tethering assembly 860, no stroke or longitudinal movement is provided for the end 886 of the link 884.

Figure 10:
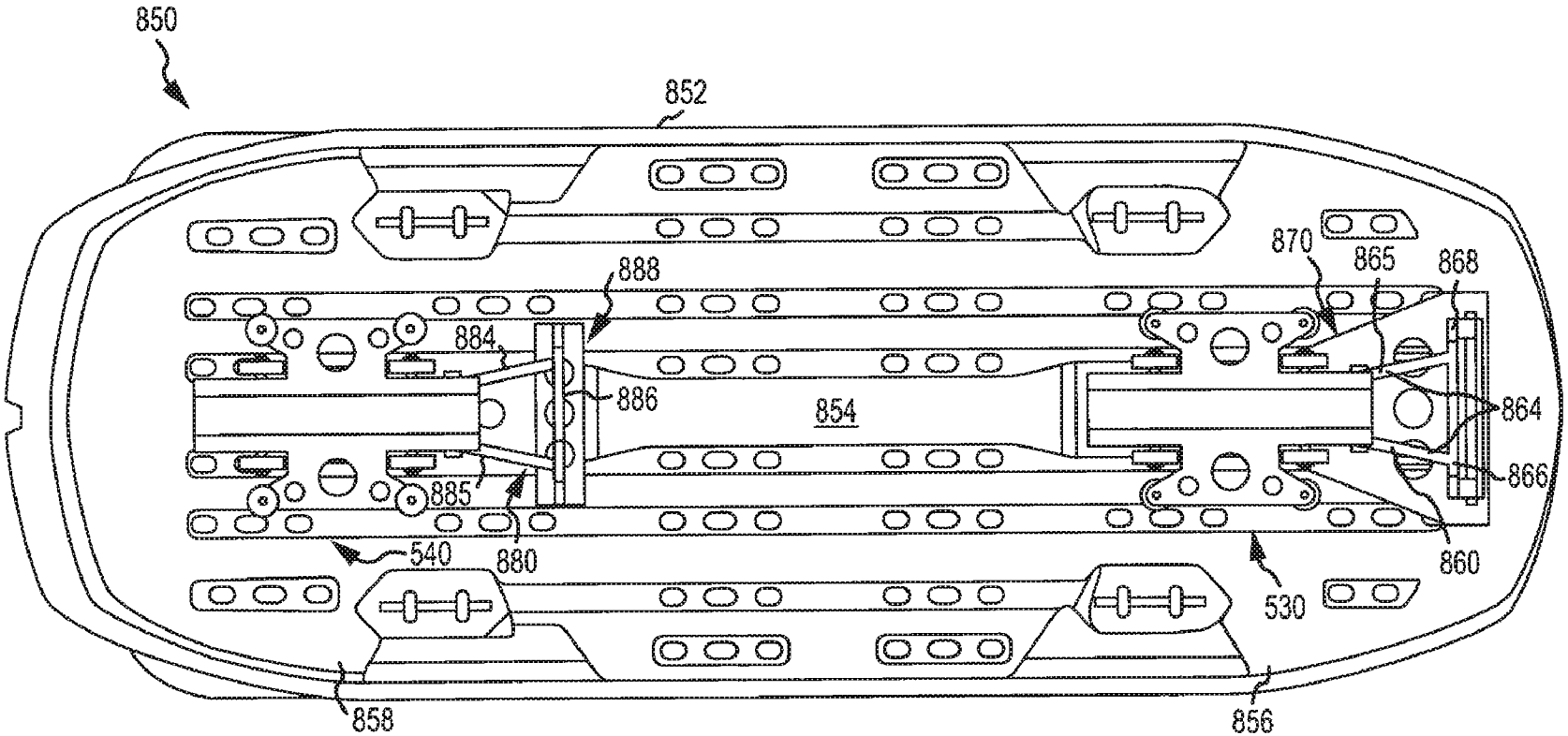
FIG. 10 is a bottom view of the boat of FIGS. 8 and 9.

FIG. 10 illustrates the front and rear bogies 530, 540 and use of the tethering assemblies 860, 880 to link the bogies 530, 540 to the front and rear portions 856, 858 of the bottom 854 of the boat hull 852. Note, in some embodiments, the rear tethering assembly 880 is also attached to the hull 852 with a longitudinal stroke as shown for front tethering assembly 860 while, in other cases, the front tethering assembly 860 has no such stroke and this movement is only provided at the rear tethering assembly. Additionally, the hard stop assembly 870 may be modified to only include a single stop such as a forward stop to allow additional travel in the rearward direction (opposite the DOT of the boat 850).

FIGS. 11-17 schematically illustrate a boat ride system 1100 at several stages of operation (or points in time or snapshots/screenshots) using independently controlled and guided front and rear bogies 1130, 1136 and associated tether points on the hull of a boat 1150 to selectively position (with controlled speed) and orient the boat 1150 as it travels along a track assembly 1110. As shown, the ride system 1100 includes a track assembly 1110 with a joined track segment 1112, a separation or branching point 1114, a divided or separated track segment downstream of the branching/ switching point 1114 made up of a primary or front bogie track 1116 and a secondary or rear bogie track 1118, a joining or union point 1120 where the tracks 1116, 1118 join the single track segment 1112.

Figure 11:
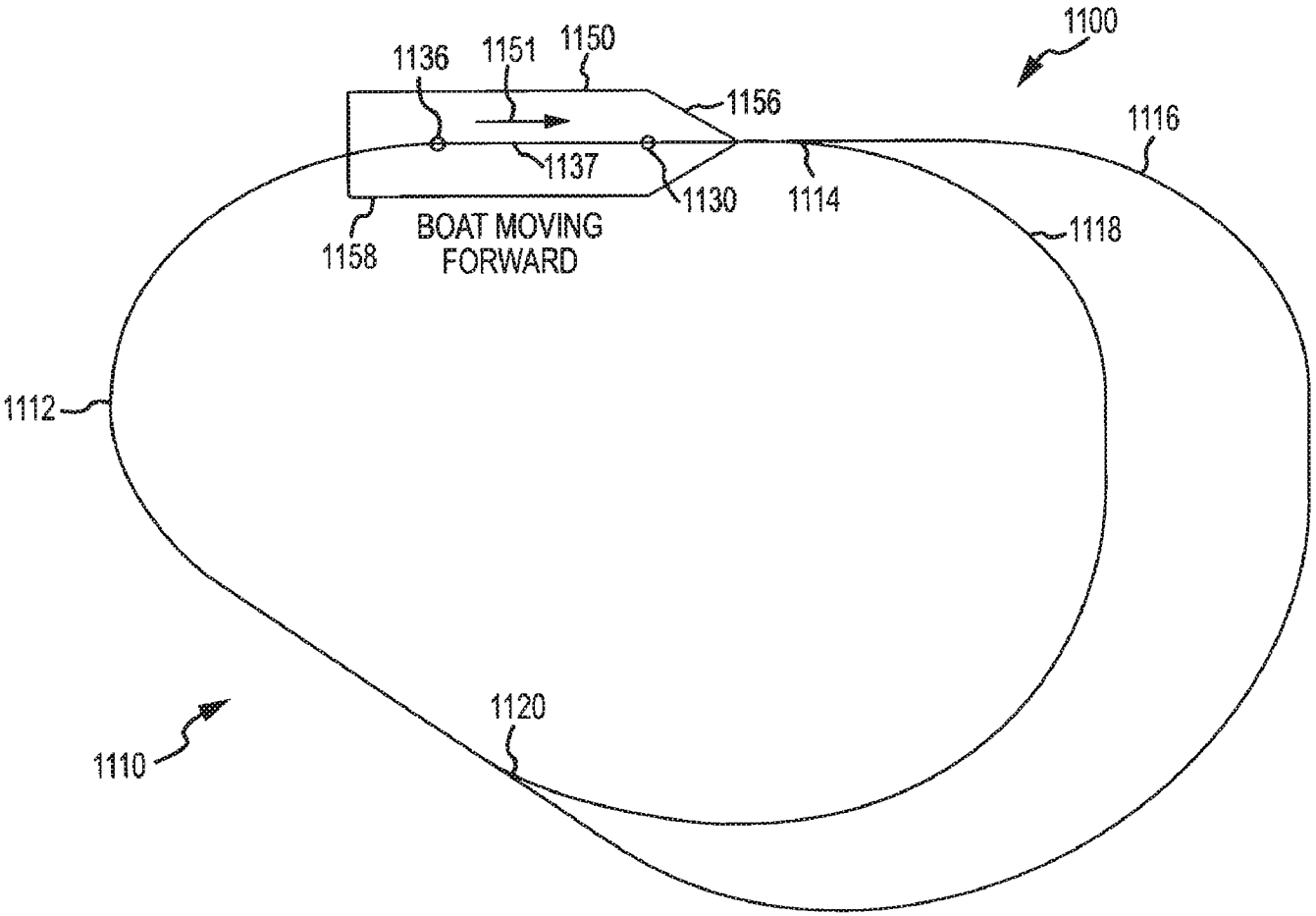
FIGS. 11-17 illustrate schematically a boat ride system at several stages of operation (or points in time) using independently controlled and guided front and rear bogies and tether points to selectively position and orient a boat as it travels along a track assembly.
Figure 15:
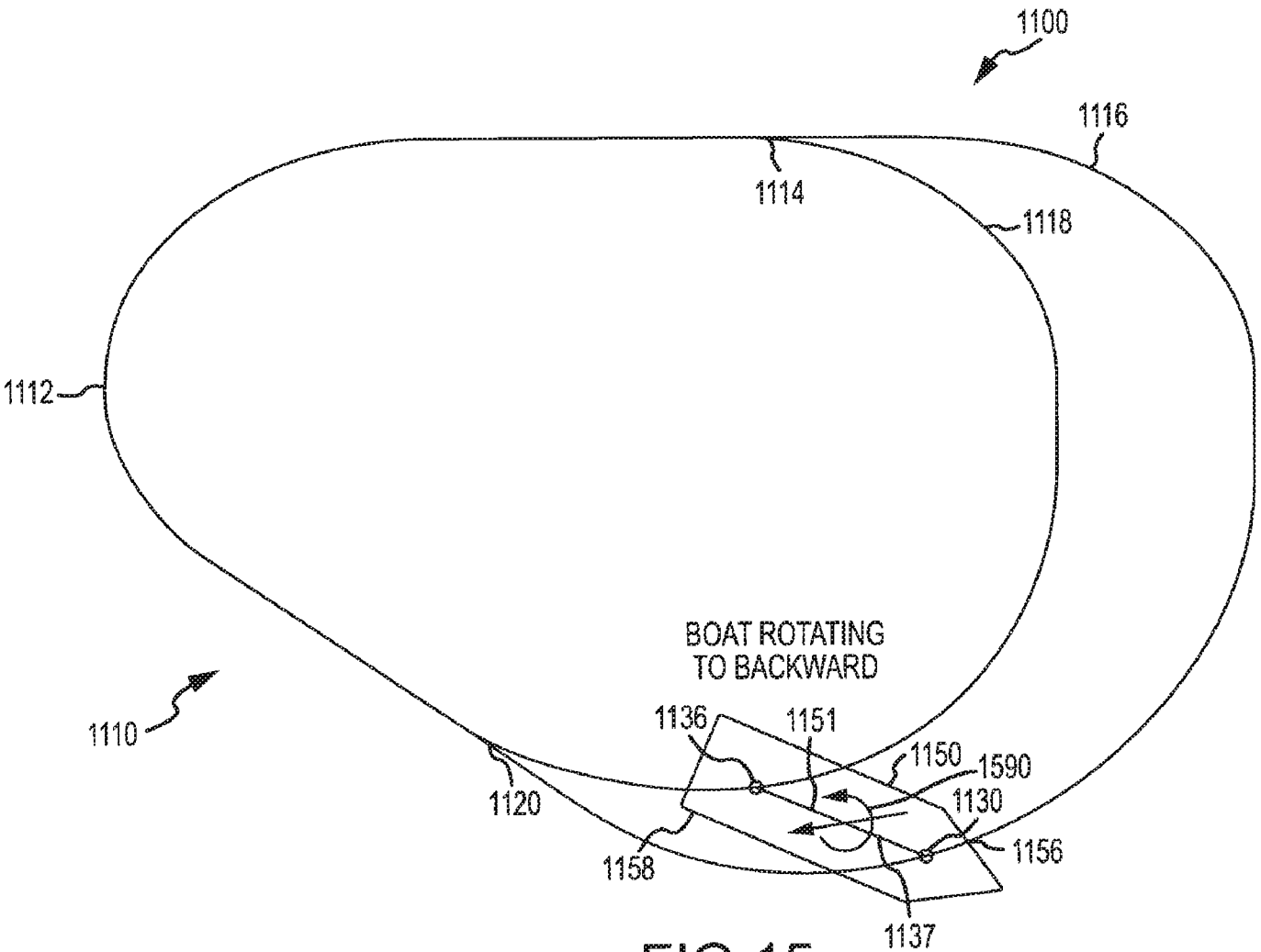
Figure 16:
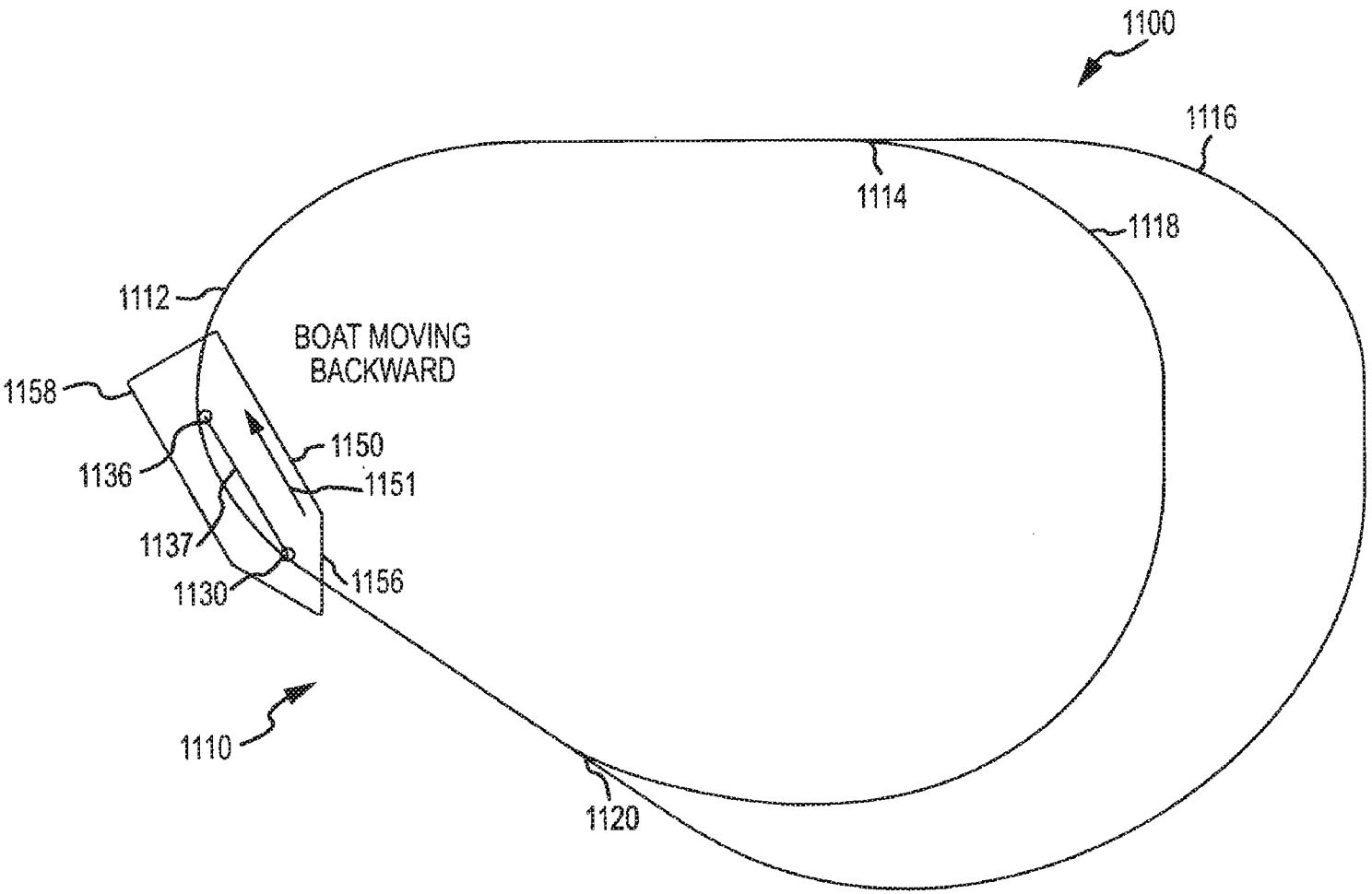

In the single or joined track segment 1112, the boat 1150 may travel forward as shown in FIG. 11 or backward as shown in FIG. 16. The boat 1150 includes a front end 1156 and a rear end 1158 such that forward travel as shown in FIG. 11 is when the front end faces forward and backward travel as shown in FIG. 16 is when the front end faces backward. In both forward and backward travel, a longitudinal axis 1137 of the boat 1150 is generally parallel to the DOT along motion arrow 1151 as defined by the track assembly 1110. The boat 1150 is coupled to the track assembly 1110 via front bogie 1130 and rear bogie 1136 (which are tethered to front and rear 1156, 1158 of the boat 1150 via tethering assemblies (not shown in FIGS. 11-17)). As discussed above, a propulsion assembly including linear motors provided under water level in the track assembly 1110 may be used to selectively propel one or both of the bogies 1130, 1136 (e.g., both in the tracks 1116, 1118 and at least one in the joined segment 1112).

FIG. 11 illustrates a period of operation of the ride system 1100 in which the boat 1150 is traveling forward 1151 in the joined track 1112. For example, the front and rear bogies 1130, 1136 may roll within a single guide channel defined by a pair of rails in segment 1112 with the front bogie 1130 being ahead of the rear bogie 1136 as the boat 1150 travels 1151 along the DOT or ride path defined by the track segment 1112.

Figure 12:
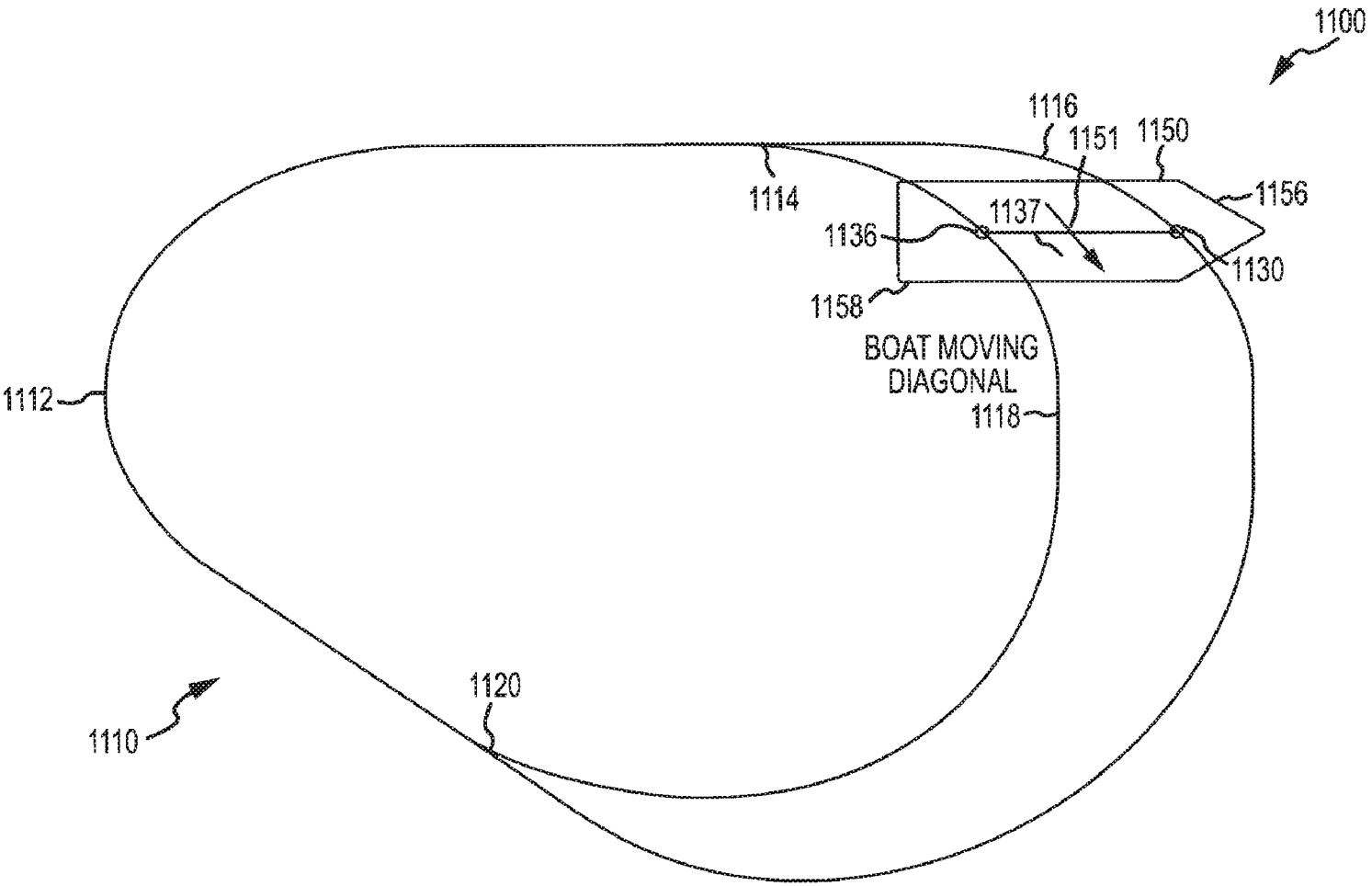

In FIG. 12, the boat 1150 has traveled past the branching point 1114 at which switching assemblies (as described above) may be provided. The switches or switching assemblies cause the front bogie 1130 to be directed into the primary or front bogie track 1116 and cause the rear bogie 1136 to be directed into the secondary or rear bogie track 1118. At this point as shown, the boat 1150 is being pulled/pushed along the tracks 1116, 1118 with a sideways orientation. In other words, neither the front 1156 nor the back 1158 of the boat 1150 is facing forward along the DOT 1151, but, instead, in this example, the DOT 1151 has been turned counterclockwise so the front 1156 faces outward (where a show element may be provided). The longitudinal axis 1137 of the boat hull is now transverse to the DOT 1151 (e.g., at about 40 to 60 degrees).

Figure 13:
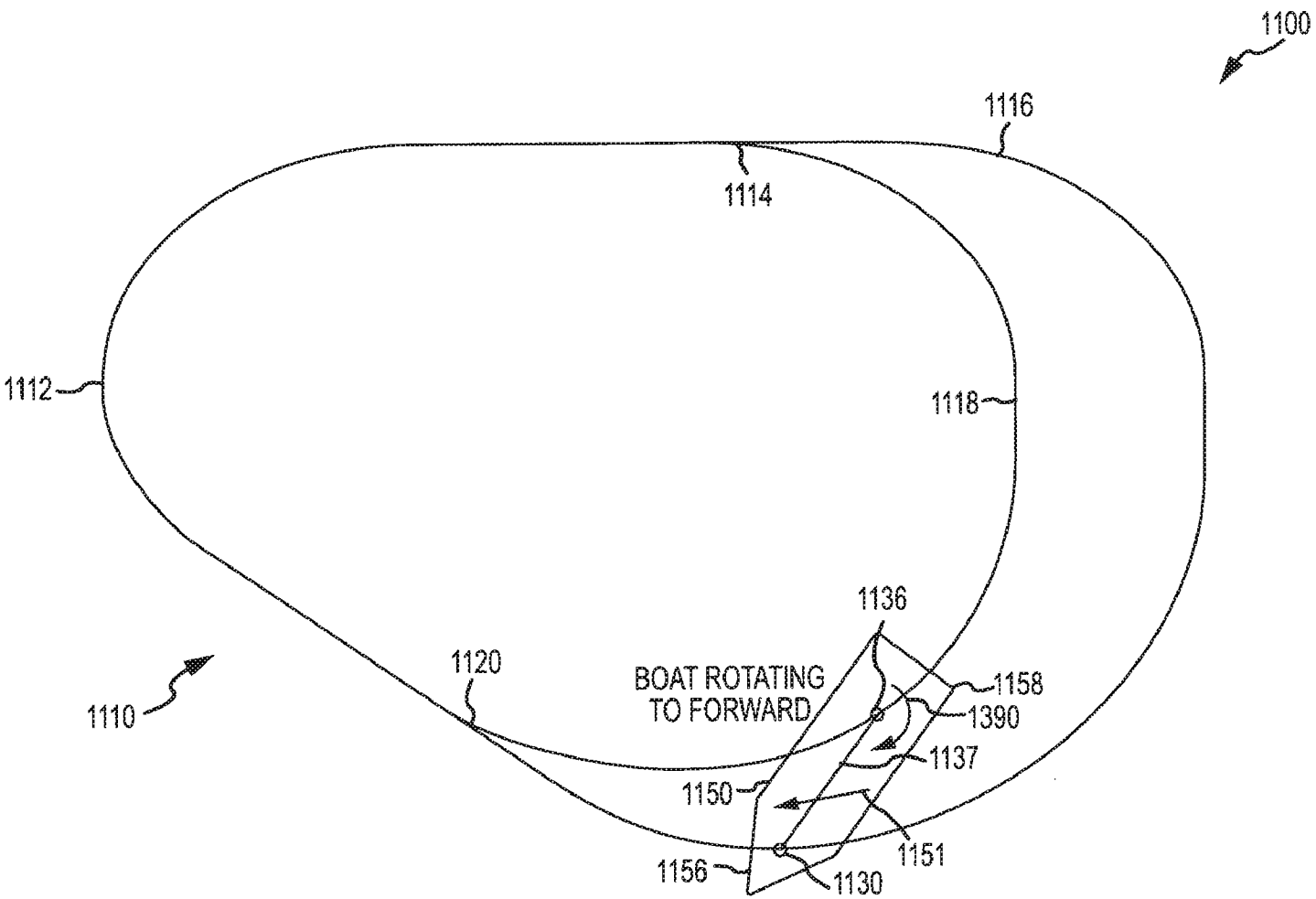
Figure 14:
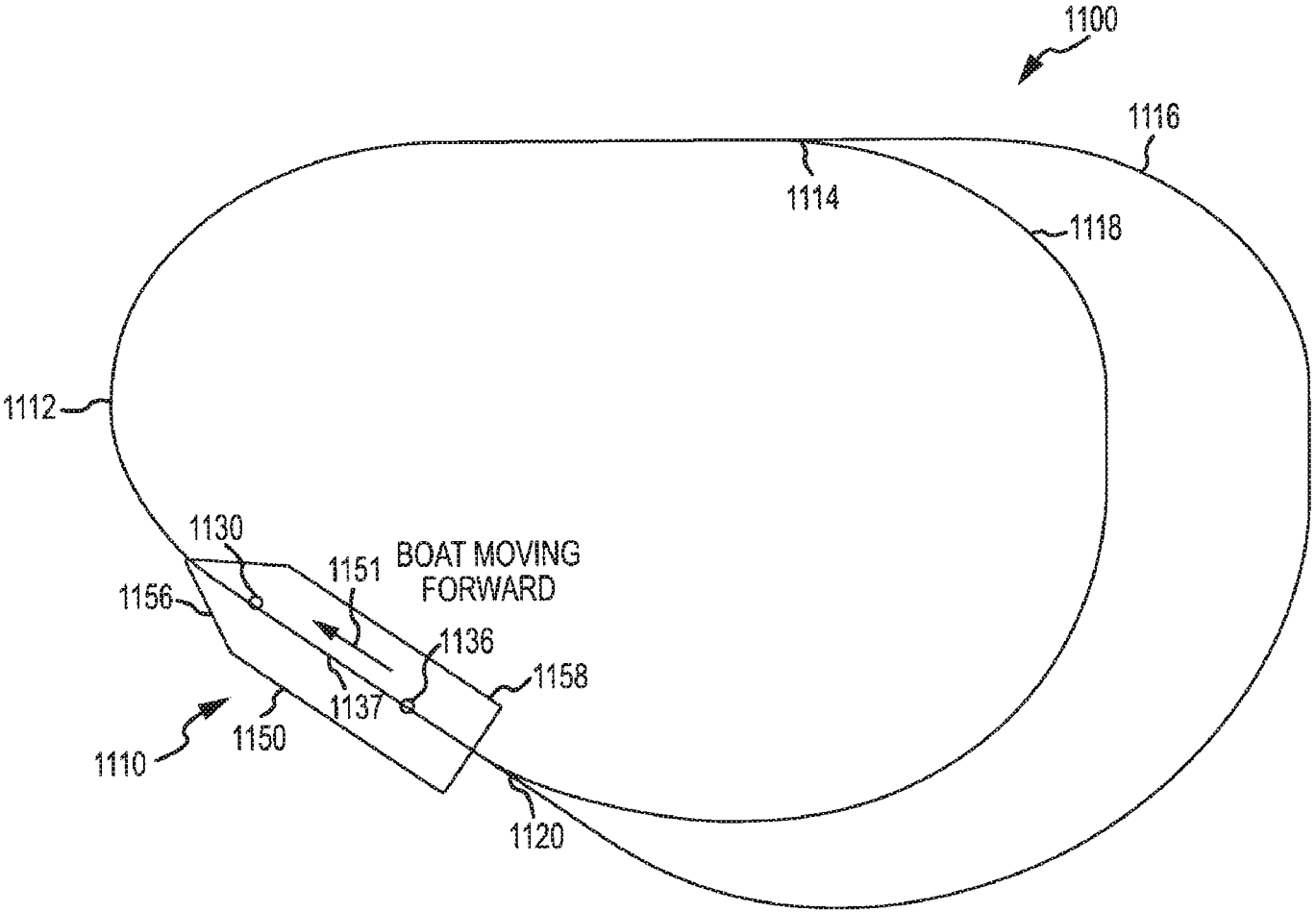

The orientation of the boat 1150 in the tracks 1116, 1118 may be controlled by operating the linear motors independently to drive the bogies 1130, 1136 at the same or differing speeds to rotate the boat 1150. For example, the track 1116 is longer than the track 1118 such that it may be useful to drive the front bogie 1130 at a quicker pace than the rear bogie 1136 to maintain a particular angular boat orientation and rotate the boat 1150. Then, as shown in FIG. 13, the relative speeds of the two bogies 1130, 1336 may be varied to cause the front end 1156 of the boat 1150 to rotate 1390 to lead the boat along the DOT 1151, e.g., to straighten the boat 1150 for forward travel as shown in FIG. 14. This may be achieved either by driving the front bogie 1130 at an increased rate in the operating stage shown in FIG. 13 and/or by driving the rear bogie 1136 at a decreased rate (e.g., speed up the front bogie 1130, slow down the rear bogie 1136, or both with selective/controlled operation of the linear motors presently driving the boat 1150). The boat 1150 may then continue on in joined track segment 1112 in a forward direction 1151.

Figure 17:
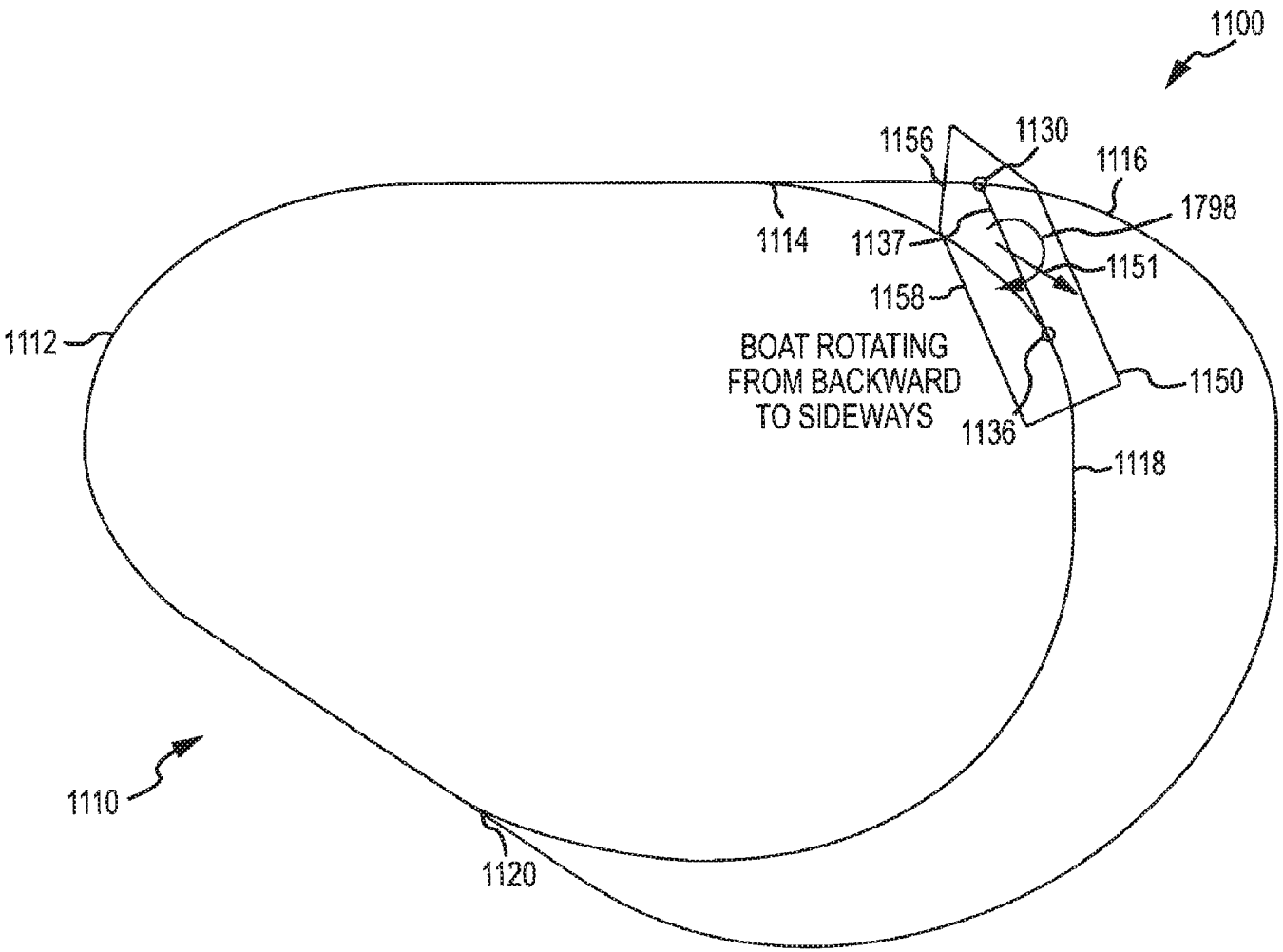

In contrast, FIG. 15 illustrates operation of the ride system 1100 to rotate the rear end 1158 of the boat 1150 such that the boat 1150 travels backward 1151 through the joined section 1112 as shown in FIG. 16. The boat rotation shown in FIG. 15 is achieved by speeding up the pace of the rear bogie 1136, slowing the pace of the front bogie 1130, or both via operation of driving linear motors. As shown in FIG. 16, the boat 1150 then travels backward 1151 through the joined track segment 1112 until it reaches the branching point 1114. Then, the boat 1150 may be rotated back to sideways as shown in FIG. 17, such as by rotating the front bogie 1130 at a higher rate than the rear bogie 1136. The examples shown in FIGS. 11-17 provide relatively simple examples of the advanced control the ride system 1100 provides over orientation of the boat 1150 relative to the DOT along the tracks (or water basin/trough (not shown)). With these basic operations understood, though, many variations and more complex movements and ride path layouts will be apparent to those skilled in the art and are considered part of this disclosure.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

The above description teaches a boat ride in which boats can be caused to act in ways that are new and very different than prior water rides. The boat rides may include a control system that controls (such as via a show program or software that selectively operates linear motors in a guide track) boat speeds, boat spacing, triggering show scenes, and orienting boats to face toward the triggered show scenes to provide enhanced storytelling that is unlike any other boat ride attraction.

As can be appreciated, the boat ride provides a number of advantages including, but not limited to: precise speed control, ability to keep boats separated with no bunching unless desired for a ride effect/show experience, ability to have boats moving at variable speeds (or a speed selected from a range of ride speeds such as 0 to 4 feet per second or the like), ability to start and stop a boat at any location (e.g., can include a show scene not available with flowing water-type rides), minimization of boat bumping to enhance passenger comfort, ability to create new ride experiences through boat movements (e.g., move sideways down a waterway, move backwards, and orient boats with a front end facing a show scene as is done with dry rides), elimination of water pumps unless water flow is desired as an aesthetic or ride effect, elimination of flume walls, ability to move a boat through a "lake" or open basin rather than only in tight or narrow troughs, and increased and/or predictable rider throughput due to precisely controlled boat speeds and spacing.

I claim:

1. A boat ride for providing enhanced control over speed and orientation of floating passenger boats, comprising:

a basin for containing a volume of liquid;

a track assembly positioned within the basin;

front and rear bogies each with two or more elements engaging the track assembly;

a passenger boat;

front and rear tethering assemblies coupling the front and rear bogies, respectively, to front and rear portions of the passenger boat; and a propulsion assembly positioned along a length of the track assembly, the propulsion assembly being operable to independently propel the front and rear bogies to move along the track assembly, wherein the track assembly includes a joined section and a divided section and wherein the divided section comprises a primary track on which the front bogie travels and a secondary track, spaced apart a distance from the primary track, on which the rear bogie travels.

2. The boat ride of claim 1, wherein the propulsion assembly includes a plurality of linear motors supported within the track assembly and wherein the front and rear bogies each include a reaction plate for magnetically interacting with the linear motors to propel the front and rear bogies at first and second velocities along a travel path defined by the track assembly.

3. The boat ride of claim 2, wherein the first and second velocities are separately controlled by operation of the linear motors.

4. The boat ride of claim 3, wherein the first velocity differs from the second velocity.

5. The boat ride of claim 3, wherein the linear motors comprise linear synchronous motors or linear induction motors.

6. The boat ride of claim 1, wherein the boat rotates to a sideways orientation in the divided section with a longitudinal axis of the boat being transverse to a travel path defined by the track assembly.

7. The boat ride of claim 6, wherein the track assembly includes track switches directing the front bogie into the primary track from the joined section and directing the rear bogie into the secondary track from the joined section.

8. The boat ride of claim 6, wherein the propulsion assembly is operated to rotate the boat in the divided section to orient the boat such that the boat travels backwards through the joined section.

9. The boat ride of claim 1, wherein the front tethering assembly includes a rigid link pivotally coupled at a first end to the front and at a second end to the front portion of the boat via a boat mounting element, the boat mounting element pivotally coupled to a stop assembly configured to allow the boat mounting element to rotate through a stroke distance.

10. A water ride with precise position and orientation control, comprising:

a track assembly including a section with a primary track and a secondary track spaced apart from the primary track;

a plurality of linear motors provided in the track assembly including in lengths of the primary and secondary tracks;

a boat;

a front bogie supported on the track assembly and guided to travel in the primary track, the front bogie being linked to a front end of the boat and including a reaction plate for magnetically interacting with proximal ones of the linear motors;

a rear bogie supported on the track assembly and guided to travel in the secondary track, the rear bogie being linked to a rear end of the boat and including a reaction plate for magnetically interacting with proximal ones of the linear motors; and a controller selectively operating the linear motors to separately propel the front and rear bogies along the track assembly.

11. The water ride of claim 10, wherein the linear motors comprise a plurality of linear synchronous motors (LSMs) or linear induction motors (LIMs) arranged end-to-end along the track assembly and wherein each of the LSMs or LIMs is independently and concurrently operable to selectively propel the front and rear bogies at first and second velocities.

12. The water ride of claim 11, wherein the first velocity differs from the second velocity in the section of the track assembly with the primary and secondary tracks.

13. The water ride of claim 12, wherein the linear motors are controlled by the controller to rotate the boat to at least one sideways orientation with a longitudinal axis of the boat transverse to a travel path defined by the track assembly.

14. An amusement park ride, comprising:

a plurality of boats for carrying passengers;

a channel for receiving water, the boats floating on a surface of any received water; and a propulsion assembly for independently propelling first and second portions of each of the boats at first and second velocities and for positioning the first and second portions to vary an orientation of each of the boats as the boats travel through the channel, wherein the propulsion assembly includes first and second bogies for each of the boats and a track assembly with a primary track and a separate secondary track guiding the first and second bogies along first and second paths in the channel and wherein the first and second bogies associated with each of the boats is linked to the first and second portion, respectively, of a bottom portion of the boat.

15. The amusement park ride of claim 14, wherein the first and second bogies are each tethered to the boats with a rigid link that is pivotally connected at first and second ends to a chassis of the bogies and the bottom portion of the boat, respectively.

16. The amusement park ride of claim 14, wherein the propulsion assembly further includes a plurality of linear motors positioned in the primary and secondary tracks and applying a magnetic thrust to a reaction plate on each of the bogies.

17. The amusement park ride of claim 14, wherein the first and second velocities differ for one or more segments of the track assembly.

18. The amusement park ride of claim 14, wherein the orientation of the each of the boats is varied among a forward orientation, a backwards orientation, a right-facing sideways orientation, and a left-facing sideways orientation during travel along the track assembly.

* * * * *